US007966956B2

(12) United States Patent
Suzuki et al.

(10) Patent No.: US 7,966,956 B2
(45) Date of Patent: Jun. 28, 2011

(54) MULTI-HEAD EMBROIDERY SEWING MACHINE

(75) Inventors: Satoru Suzuki, Komaki (JP); Yuichiro Suzuki, Kasugai (JP); Katsuharu Yoshikawa, Tajimi (JP)

(73) Assignee: Tokai Kogyo Mishin Kabushiki Kaisha (JP)

( * ) Notice: Subject to any disclaimer, the term of this patent is extended or adjusted under 35 U.S.C. 154(b) by 1078 days.

(21) Appl. No.: 11/748,833

(22) Filed: May 15, 2007

(65) Prior Publication Data

US 2007/0261621 A1 Nov. 15, 2007

(30) Foreign Application Priority Data

May 15, 2006 (JP) ..... 2006-135543

(51) Int. Cl.
*D05C 3/02* (2006.01)

(52) U.S. Cl. ..... 112/98; 112/78

(58) Field of Classification Search ..... 112/102.5, 112/96, 78, 255, 155, 220, 241, 235, 163, 112/470.06, 166, 98
See application file for complete search history.

(56) References Cited

U.S. PATENT DOCUMENTS

| | | | | |
|---|---|---|---|---|
| 5,474,001 | A | 12/1995 | Tajima et al. | |
| 5,791,274 | A * | 8/1998 | Akahane et al. | 112/470.04 |
| 5,794,554 | A * | 8/1998 | Akahane et al. | 112/470.01 |
| 5,832,851 | A * | 11/1998 | Kato | 112/470.01 |
| 6,698,369 | B2 * | 3/2004 | Kwak | 112/102.5 |
| 6,874,437 | B2 * | 4/2005 | Kim | 112/102.5 |
| 6,925,946 | B1 * | 8/2005 | Kang | 112/102.5 |
| 7,252,044 | B2 * | 8/2007 | Lee | 112/102.5 |

FOREIGN PATENT DOCUMENTS

| | | |
|---|---|---|
| JP | 04-051991 A | 2/1992 |
| JP | 04-347192 A | 12/1992 |

* cited by examiner

*Primary Examiner* — Danny Worrell
(74) *Attorney, Agent, or Firm* — Rossi, Kimms & McDowell LLP

(57) ABSTRACT

Individual motors in a sewing machine of the invention are provided, for each of a plurality of machine heads, for individually driving respective mechanical components, such as a needle bar driving mechanism, thread take-up lever and presser foot mechanism. A plurality of rotary hooks are driven by a common motor. Even in a case where embroidering workpieces set on the individual machine heads differ in material between the heads and upper threads used for the machine heads differ in characteristic between the heads, the sewing machine can make, in a concurrent, parallel fashion, embroidery products of different texture suited for the respective materials, characteristics, etc., by setting independent stitch formation per machine head.

15 Claims, 19 Drawing Sheets

MULTI-HEAD EMBROIDERY SEWING MACHINE

BACKGROUND OF THE INVENTION

The present invention relates to multi-head embroidery sewing machines equipped with a plurality of machine heads each having a plurality of sewing mechanical components that include a needle bar, thread take-up lever and presser foot.

The multi-head embroidery sewing machines are equipped with a plurality of machine heads each including a needle bar, thread take-up lever, presser foot, etc., and rotary hooks corresponding to the heads. In typical examples of the conventionally-known multi-head embroidery sewing machines, the needle bar, presser foot, thread take-up lever, etc. are driven in an interlocked manner by a single drive shaft (main shaft), extending through all of the machine heads, via power converting elements (cams, gears, etc.) provided in the individual machine heads. However, in these typical examples, motion conversion between the needle bar, thread take-up lever and presser foot was impossible. Japanese Patent Application Laid-open Publication No. HEI-4-51991 (hereinafter referred to as Patent Literature 1) and U.S. Pat. No. 5,474,001 (which corresponds to the No. HEI-4-51991 publication and will hereinafter be referred to as Patent Literature 2) disclose a technique which permits motion conversion between the needle bar, thread take-up lever and presser foot by driving these components by separate or individual drive sources.

In the multi-head embroidery sewing machine disclosed in Patent Literature 1, individual drive sources (e.g., motors) for driving the needle bars, thread take-up levers and presser feet, respectively, of all of the machine heads; namely, the drive sources for driving the needle bars, thread take-up levers and presser feet are shared among the machine heads, and drive shafts, driven by the respective drive sources (motors), extend through all of the machine heads for shared use among the machine heads. In each of the machine heads, rotation of the drive sources is transmitted to corresponding mechanisms of the needle bar, thread take-up lever and presser foot. Thus, although motion conversion is permitted between the mechanisms of the needle bar, the thread take-up lever and presser foot through separate control of the individual motors, the respective motions of the thread take-up lever and presser foot are all the same among the machine heads. Therefore, whereas the disclosed sewing machine is suited to sew embroidery products with stitch formation (conditions) common to the individual machine heads, it is not at all suited to sew embroidery products with stitch formation differing among the machine heads. However, because the essential technical idea of the multi-head embroidery sewing machines is, as well known, to sew same embroidery patterns with same stitch formation via a plurality of parallel machine heads to thereby mass-produce embroidery products, no particular inconvenience has heretofore been felt from the viewpoint of the conventional technical idea.

Further, Japanese Patent Application Laid-open Publication No. HEI-4-347192 (hereinafter referred to as Patent Literature 3) discloses a multi-head embroidery sewing machine, in which independent or separate drive sources (motors) for individually driving a needle bar, thread take-up lever and presser foot are provided per machine head and in which a separate drive source (motor) for driving a rotary hook is also provided per machine head.

However, the sewing machine disclosed in Patent Literature 3 too is merely based on the aforementioned conventional technical idea; namely, Patent Literature 3 discloses nothing more than providing independent drive sources (motors) per machine head. Further, form of control disclosed in Patent Literature 3 is not so different from that disclosed in Patent Literature 1, and the control is only intended to permit motion conversion between the mechanisms of the needle bar, thread take-up lever and presser foot through separate control of the motors for the needle bar, thread take-up lever and presser foot. In addition, with the sewing machine disclosed in Patent Literature 3, effectiveness of the provision of the rotary hook drive source (motor) per machine head was not considered sufficiently. Namely, it was not considered that the rotary hook drive source (motor) provided per machine head would rather become superfluous equipment for the rotary hook that is subjected to only a small load.

The aforementioned technical ideas of the conventional multi-head embroidery sewing machines is based on the concept that same embroidery products only have to be completed on all of the machine heads with embroidering workpieces (such as fabric or leather) having same characteristics (thickness, degree of stretchability, etc.) set on the individual machine heads and with upper threads having same characteristics (thickness, degree of stretchability, etc.) used for sewing. However, in the embroidery product manufacturing industry too, there has recently been an increasing demand for small-lot production of a wide variety of products. Nevertheless, the conventionally-known multi-head embroidery sewing machines of the type which mass-produce same products can not at all satisfy such a demand for small-lot production of a wide variety of products.

Further, in the multi-head embroidery sewing machine disclosed in Patent Literature 1, where the drive shafts extend through all of the machine heads, as the number of the machine heads increases, the drive shafts have to have increased lengths, so that the rotationally-driven drive shafts tend to undesirably twist. For example, a relative great twist or torsion tends to be produced in the drive shaft for a needle bar driving mechanism, which would result in relatively great time differences in up-and-down movement between the machine heads located remotely from each other. Such great operation time differences would lead to time differences in needle and rotary hook motion between the machine heads located remotely from each other and hence to deviations in stitch formation between the machine heads. Further, phase differences in thread take-up lever motion between the machine heads could cause desynchronization between the motion of the thread take-up levers and the rotation of the rotary hooks, which would also lead to differences in stitch formation between the machine heads. Thus, even where embroidering workpieces and threads of same material and characteristics are used in all of the machine heads, it would be difficult to obtain embroideries of the same quality. The greater the number of the machine heads, the more pronounced such unwanted tendencies become. Thus, although the greater number of the machine heads can advantageously achieve a greater number of embroidery products, it would simultaneously present the demerit that embroidery products of the same quality can not be obtained in all of the machine heads. Further, because all of the machine heads are driven by the common elongated drive shafts, the drive shafts themselves tend to produce great vibration and sound noise, and this tendency would become more serious as the number of the machine heads increases and as the rotating speed of the drive shafts increase. Therefore, the conventionally-known embroidery sewing machine could not achieve an increased operating speed, although strenuous efforts have been made so far to create effective anti-vibration measures.

Furthermore, when there has occurred a need for repair work involving component part replacement in any of the machine heads in the conventionally-known multi-head embroidery sewing machines, it is necessary for a human operator to perform the repair work consuming great amounts of time and labor. In addition, during the repair work, the embroidery sewing machine has to be placed in a complete non-operating (deactivated) condition, which would cause a lot of inconveniences to a user of the sewing machine. For example, when repair work requiring replacement of a cam for driving the needle bar or thread take-up lever in the sewing machine of the type disclosed in Patent Literature 1, the drive shaft extending through all of the machine heads has to be taken out or removed; for such a purpose, the human operator has to perform extremely troublesome repair operation, e.g. first loosening all couplings of cams etc. in all of the machine heads, then taking out the drive shaft, removing the deficient component part, setting a replacing component part while again passing the drive shaft through all of the machine heads and then again coupling the cams etc. in all of the machine heads.

Furthermore, in the conventionally-known embroidery sewing machines, machine heads corresponding to different types of sewing, such as ordinary sewing and special sewing (e.g., strand-like or string-shaped material sewing) machine heads, are mounted fixedly. Thus, it has heretofore been inconceivable to replace, for example, an ordinary sewing (lock-stitching) machine head with a "handwheel-operated machine head" (or handwheel-operated lock-stitching machine head capable of sewing a string-shaped material, such as a tape or cord, onto a fabric) or vice versa in the same sewing machine. Further, in the conventionally-known embroidery sewing machines, which are constructed to select same needle bars (i.e., same color threads) concurrently in all of the machine heads, it is not possible to make, in a concurrent, parallel fashion, embroideries having different color-thread patterns although having a same outline design.

SUMMARY OF THE INVENTION

In view of the foregoing, it is an object of the present invention to provide an improved multi-head embroidery sewing machine which can appropriately satisfy a need for small-lot production of a wide variety of products. It is another object of the present invention to provide an improved multi-head embroidery sewing machine which can avoid unevenness in finished product quality between machine heads. It is still another object of the present invention to provide an improved multi-head embroidery sewing machine which is suited for high-speed operation. It is still another object of the present invention to provide an improved sewing machine which is suited for replacement and repair of component parts employed therein. It is still another object of the present invention to provide an improved sewing machine which is capable of readily switching between different sewing functions by appropriately replacing one type of machine head with another type (i.e., switching between different types of machine heads). It is still another object of the present invention to provide an improved multi-head sewing machine which permits a needle bar selection (color thread selection) independently per machine head.

In order to accomplish the aforementioned objects, the present invention provides a multi-head embroidery sewing machine including a plurality of machine heads each provided with a plurality of sewing mechanical components that include a needle bar driving mechanism, thread take-up lever and presser foot mechanism, which comprises: individual motors provided per machine head for individually driving respective ones of the mechanical components including the needle bar driving mechanism, thread take-up lever and presser foot mechanism; a common motor provided for driving a plurality of rotary hooks that are disposed beneath the respective machine heads; and a transmission mechanism for transmitting rotation of the common motor to the rotary hook of each of the machine heads.

The present invention is characterized in that the individual or separate (or independent) motors are provided per machine head for individually driving the respective mechanical components including the needle bar driving mechanism, thread take-up lever and presser foot mechanism while the common motor is provided for driving the plurality of rotary hooks. With the independent motor provided not only per machine head but also per mechanical component, the present invention can control independently, per machine head, respective motions of the needle bar, thread take-up lever and presser foot that are important in setting/changing stitch formation (conditions). Further, with the common motor provided for driving the rotary hooks, the present invention can effectively avoid superfluous or excessive equipment. Thus, even in a case where embroidering workpieces set on the individual machine heads differ in material between the machine heads and upper threads used in the machine heads differ in characteristic (thickness, degree of stretchability, etc.) between the machine heads, the sewing machine of the present invention can make, in a concurrent, parallel fashion, embroidery products of different texture suited for the respective materials, characteristics, etc., by setting different or independent stitch formation per machine head. As a result, small-lot production of a variety of types of embroidery productions can be achieved with an enhanced efficiency by the single multi-head embroidery sewing machine of the present invention.

For example, by using a different upper thread per machine heads, the sewing machine of the present invention can make embroidery products of texture differing between the machine heads even though same embroidery pattern data are used for all of the machine heads. In such a case, there is a need to set/change the operating motion of the thread take-up lever of each of the machine heads in accordance with the characteristics of the upper thread used in the machine head, in order to perform appropriate embroidery sewing per machine head. Further, it is also possible for the sewing machine of the present invention to concurrently sew embroideries of a same design to embroidering workpieces of various materials, by setting, as the embroidering workpieces, a thin fabric, thick fabric and leather (that tends to require great needle insertion and pull-out forces and vary in thickness from one case to another) on the machine heads. For that purpose, there is a need to change or adjust, per machine head, motions of the presser foot and needle bar, in accordance with the characteristics (thickness and needle insertion/pull-out resistance) of the embroidering workpieces. However, with the conventional techniques disclosed in Patent Literature 1 and Patent Literature 3, such embroidery sewing was not achievable or conceivable at all. By contrast, the present invention, which can control each of the motions of the needle bar, thread take-up lever and presser foot independently per machine head, can drive these mechanical components to make operating motions suited for the material of the embroidering workpiece and characteristics of the upper thread used in the machine head, so that it can concurrently make embroidery products differing in texture between the machine heads.

As a result, the sewing machine of the present invention is very suited for small-lot production of a variety of types of embroidery productions.

Furthermore, the present invention, which is constructed to avoid the problem of torsion or twisting of the drive shaft, can reliably prevent an unwanted operation time difference between the needle and the rotary hook and desynchronization of the thread take-up lever motion; thus, when embroidery products of uniform quality are to be made on the plurality of machine heads, the present invention can effectively avoid non-uiformity in finished product quality between the machine heads. Furthermore, because the present invention can eliminate the problems of vibration of the dive shaft and sound noise, it can be highly suited for high-speed operation. Besides, even when there has occurred a need for repair work involving component part replacement in any of the machine heads, the present invention, which permits repair work on a head-by-head basis, can perform the repair work promptly and easily without the entire sewing machine being brought to a non-operating (deactivated) condition.

According to another aspect of the present invention, there is provided a multi-head embroidery sewing machine including a plurality of machine heads each provided with a plurality of sewing mechanical components that include a needle bar driving mechanism, thread take-up lever and presser foot mechanism, which comprises: individual motors provided per machine head for individually driving respective ones of the mechanical components including the needle bar driving mechanism, thread take-up lever and presser foot mechanism; a control device for individually controlling each of the individual motors per machine head; and a setting section for individually setting content of control, by the control device, of each of the motors per machine head.

As set forth above, the present invention is constructed to individually control the motors of the mechanical components per machine head and set different or independent stitch formation (conditions) per machine head. Thus, even in a case where embroidering workpieces set on the individual machine heads differ in material between the machine heads and upper threads used in the machine heads differ in characteristic (thickness, degree of stretchability, etc.) between the machine heads, the sewing machine of the present invention can make, in a concurrent, parallel fashion, embroidery products of different texture suited for the respective materials, characteristics, etc. As a result, small-lot production of a variety of types of embroidery productions can be achieved with an enhanced efficiency by the single sewing machine of the present invention.

According to still another aspect of the present invention, there is provided an improved sewing machine, which comprises: a support provided on a machine frame and having mounted thereon a plurality of sewing mechanical components that include a needle bar driving mechanism, thread take-up lever and presser foot mechanism, a rotary hook being disposed beneath the support; and individual motors mounted on the support for individually driving respective ones of the mechanical components including the needle bar driving mechanism, thread take-up lever and presser foot mechanism, the support being constructed as a modulized support, the modulized support being detachably attached, as an integral unit, to the machine frame.

Namely, the support, i.e. machine head, is constructed as a modulized structure on which are mounted the plurality of sewing mechanical components and the individual motors for individually driving the respective mechanical components including the needle bar driving mechanism, thread take-up lever and presser foot mechanism. Because of the modulized construction, the whole machine head can be replaced with another machine head when it has failed. Therefore, the machine head is constructed to be suited for replacement or repair of a component part, which can thereby minimize a length of time over which it may cause inconveniences to a user at the time of the replacement or repair. Further, because one type of machine head can be replaced with another type in the same sewing machine, the same sewing machine can be used with an enhanced efficiency by, for example, replacing an ordinary sewing (lock-stitching) machine head with a handwheel-operated (lock-stitching) machine head or vice versa.

According to still another aspect of the present invention, there is provided an improved multi-head sewing machine including: a plurality of sewing mechanical components that include a needle bar driving mechanism, thread take-up lever and presser foot mechanism; and a support having slidably mounted thereon a needle bar case having a plurality of needle bars, which comprises: individual motors provided, for each of the supports, for individually driving respective ones of the mechanical components including the needle bar driving mechanism, thread take-up lever and presser foot mechanism; and a motor provided, for each of the supports, for sliding the needle bar case, so that any desired one of the needle bars is selectable for each of the supports. Because the needle selection (color thread selection) is performed by the independent motor for each of the supports or machine heads, the present invention can make, in a concurrent, parallel fashion, embroideries having different color-thread patterns although having a same outline design.

According to still another aspect of the present invention, there is provided a sewing machine comprising: a needle bar case having a plurality of needle bars; a driving mechanism for sliding the needle bar case to position one of the needle bars in a selected position; a needle bar driving mechanism for moving up and down the needle bar, positioned in the selected position, to perform a sewing operation; a stopper member for retaining each needle bar, not currently selected for sewing, in a predetermined uppermost position; and a member for limiting a top dead point of a particular needle bar, currently selected for sewing, to a predetermined position lower than the predetermined uppermost position, the particular needle bar, currently selected for sewing, being prevented from abutting against the stopper member during vertical movement thereof. With the arrangement that the particular needle bar, currently selected for sewing, is prevented from abutting against the stopper member during its vertical (up-and-down) movement, the present invention can reliably avoid inconveniences caused by repeated abutment of the needle bar against the stopper member (such as spattering of machine lubricating oil caused by the needle clamp abutting against the stopper member). Particularly, the sewing machine of the present invention arranged in the aforementioned manner can be advantageously applied to a case where one presser foot is provided in correspondence with the selected position and a motor is provided for independently driving the presser foot.

According to still another aspect of the present invention, there is provided a presser foot mechanism in a sewing machine, which comprises: a presser foot; a motor for driving the presser foot; a motion conversion mechanism for vertically moving, in response to activation of the motor, the presser foot between predetermined top and bottom dead points during a sewing operation, and for retracting, in response to activation of the motor, the presser foot to an evacuated position when no sewing operation is to be performed. Here, in retracting the presser foot to the evacuated position, the motion conversion mechanism rotates the presser foot so as to cause a needle hole, formed at a distal end portion of the presser foot, to escape from a needle position. The presser foot mechanism of the present invention can be advantageously applied to a case where one presser foot is provided independently of each of needle bars of a needle bar case. In such a case, the present invention can prevent the distal end of the presser foot from interfering with the distal end of each of the needle bars.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the objects and other features of the present invention, its preferred embodiments will be described hereinbelow in greater detail with reference to the accompanying drawings, in which.

DETAILED DESCRIPTION OF THE INVENTION

Figure 1:
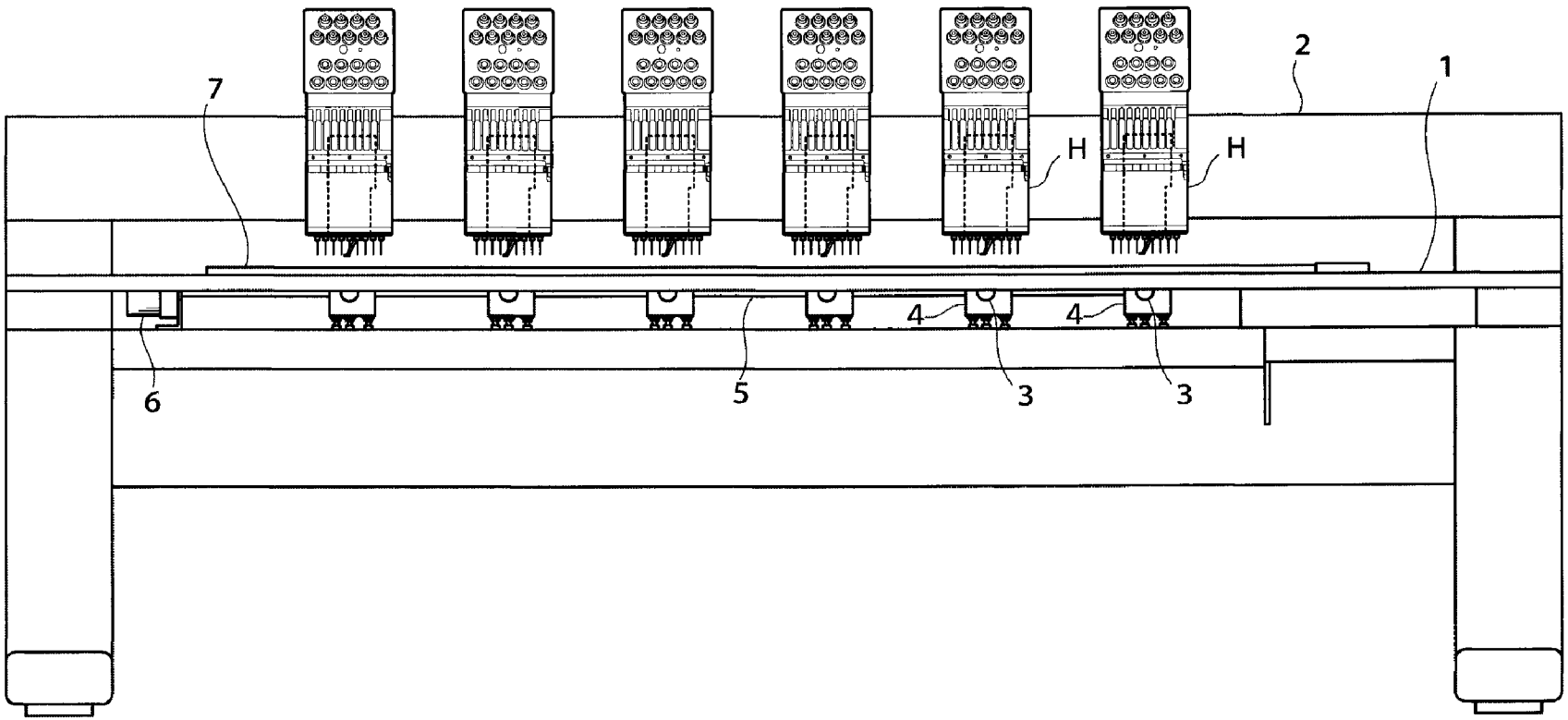
FIG. 1 is a front view showing an example outer appearance of a multi-head embroidery sewing machine in accordance with an embodiment of the present invention.

FIG. 1 is a front view showing an example outer appearance of a multi-head embroidery sewing machine of in accordance with an embodiment of the present invention, where reference numeral 1 represents a machine table and 2 an upper frame of the sewing machine. A plurality of (six in the illustrated example) embroidering heads (machine heads) H are provided on the upper frame 2, and hook bases 4, each supporting a rotary hook 3, are provided, in corresponding relation to the embroidering heads H, under the respective embroidering heads H at generally the same height as the machine table 1. One drive shaft 4 extends through the individual hook bases 4 and has one end connected to one hook driving motor 6 (i.e., rotary hook driving motor 6 commonly used among all of the rotary hooks 3). As the drive shaft 5 rotates by being driven by the common driving motor 6, the individual rotary hooks 3, provided in corresponding relation to the machine heads H, are driven to rotate together. Because the rotary hooks 3 are not subjected to a great load and slight deviations in rotational position between the rotary hooks 3 do not greatly influence embroidery stitch formation, and for other reasons, no significant problem results even in the case where the driving force of the common rotary hook driving motor 6 is transmitted to the rotary hooks 3 via the single drive shaft 5 without a separate driving motor being provided for each of the rotary hooks 3; rather, the common driving motor arrangement is more advantageous for the following reason. Namely, in this case, no problem, such as torsion or twisting of the drive shaft 5, would take place, or, if any, it would not influence the finished state of embroidery products. From such a point of view, the arrangement where the plurality of rotary hooks 3 are driven via the common motor 6 and single drive shaft (transmission mechanism) 5 is very advantageous in that it can eliminate a need for superfluous equipment (e.g., provision of a separate rotary hook driving motor per embroidering head H).

Figure 2:
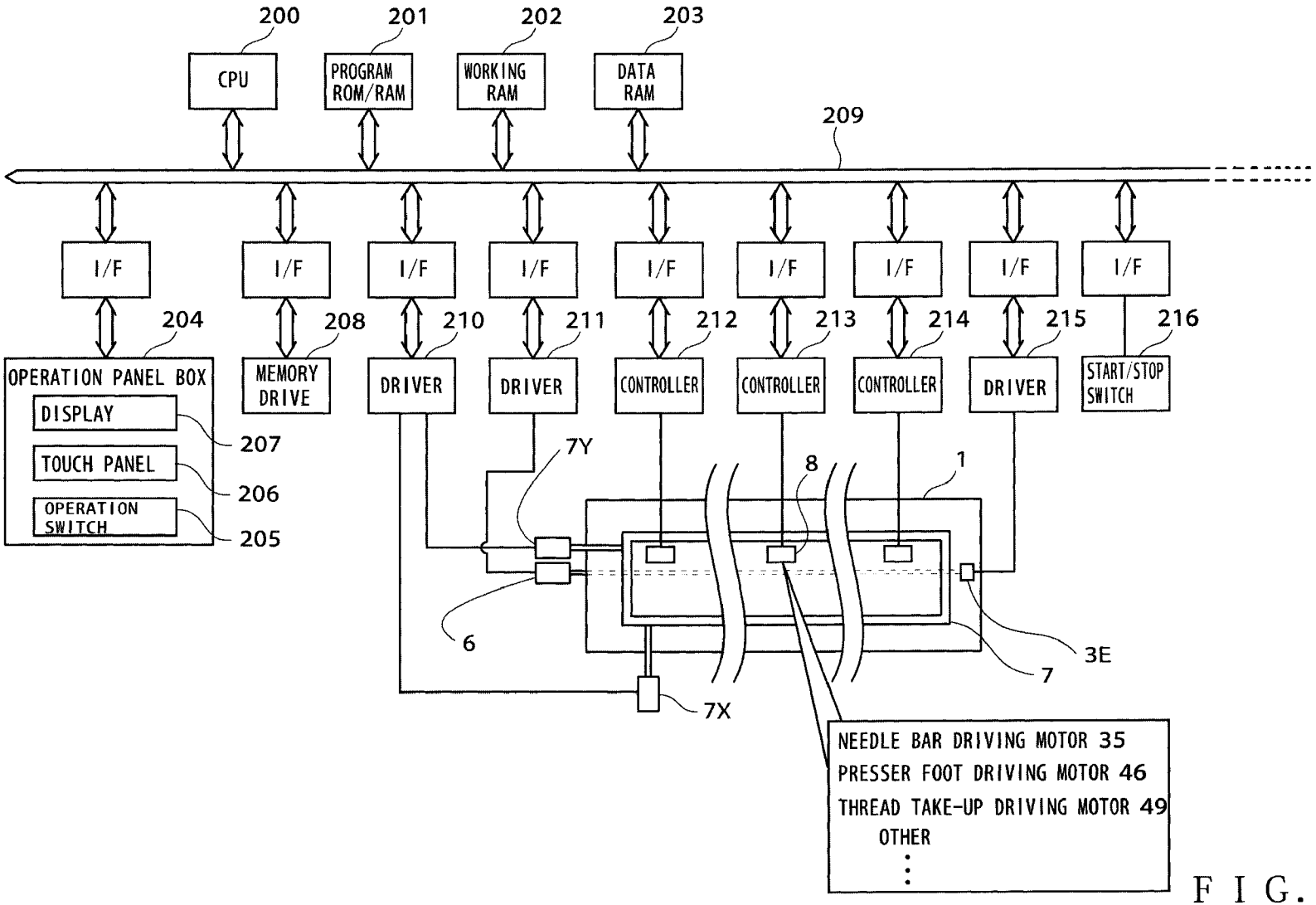
FIG. 2 is a block diagram illustrating an example control system of the multi-head embroidery sewing machine according to the embodiment.

As shown in a control system block diagram of FIG. 2, an encoder (rotational position detector) 3E for detecting a rotational angle of each of the rotary hooks 3 is provided on the drive shaft 5. Of course, the encoder (rotational position detector) 3E may be provided to directly detect the rotation of the common rotary hook driving motor 6, or may be provided to directly detect the rotation of any one of the rotary hooks 3.

Holding frame 7 for holding sewing workpieces in a stretched-taut condition is provided on the upper surface of the machine table 1. As known in the art, the holding frame 7 is driven, on a stitch-by-stitch basis, in X and Y directions by an embroidery frame driving mechanism (e.g., X-axis motor 7X and Y-axis motor 7Y shown in FIG. 2) in accordance with embroidery sewing data.

Figure 3:
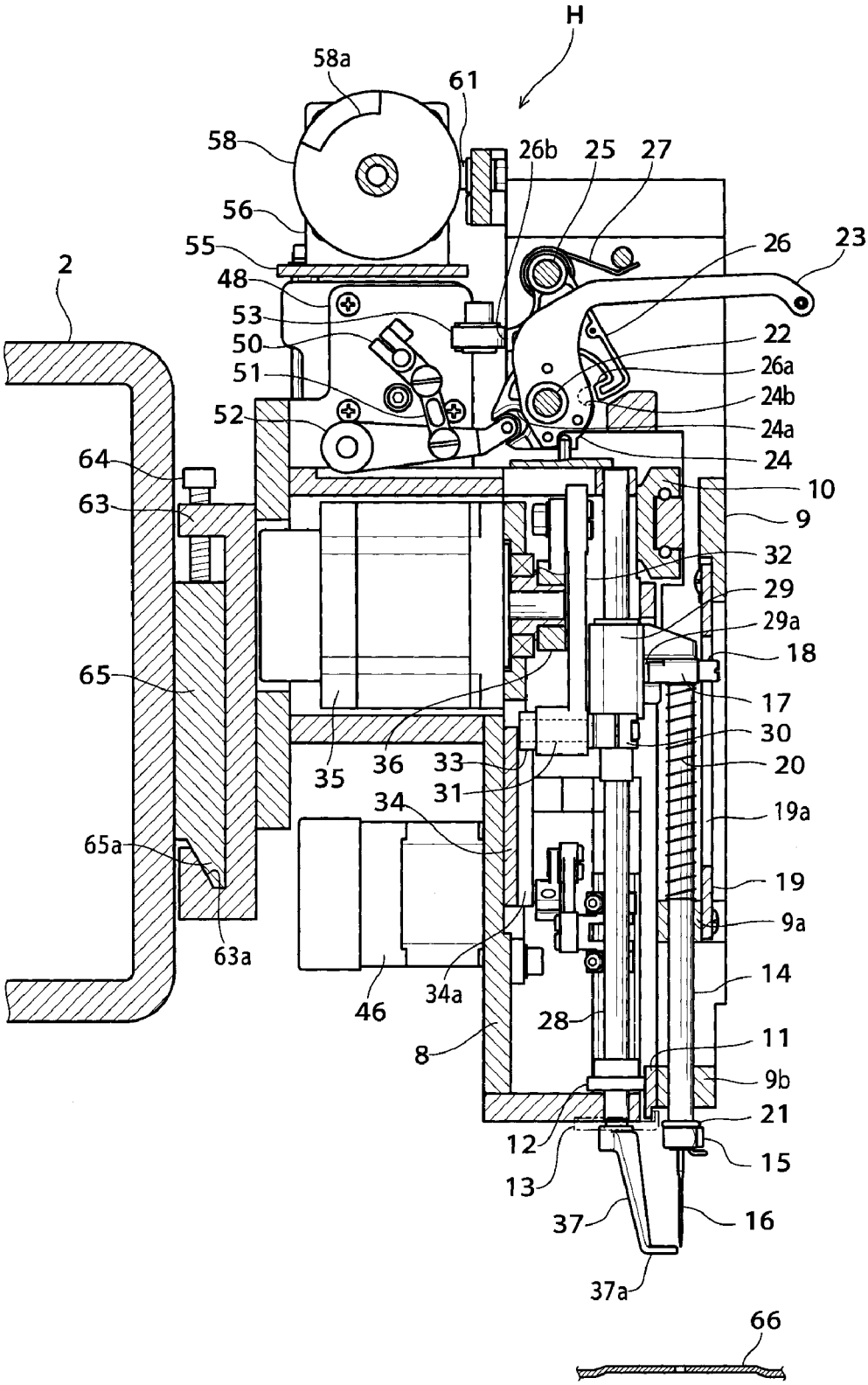
FIG. 3 is a sectional left side view showing in enlarged scale one embroidering head employed in the embodiment.
Figure 4:
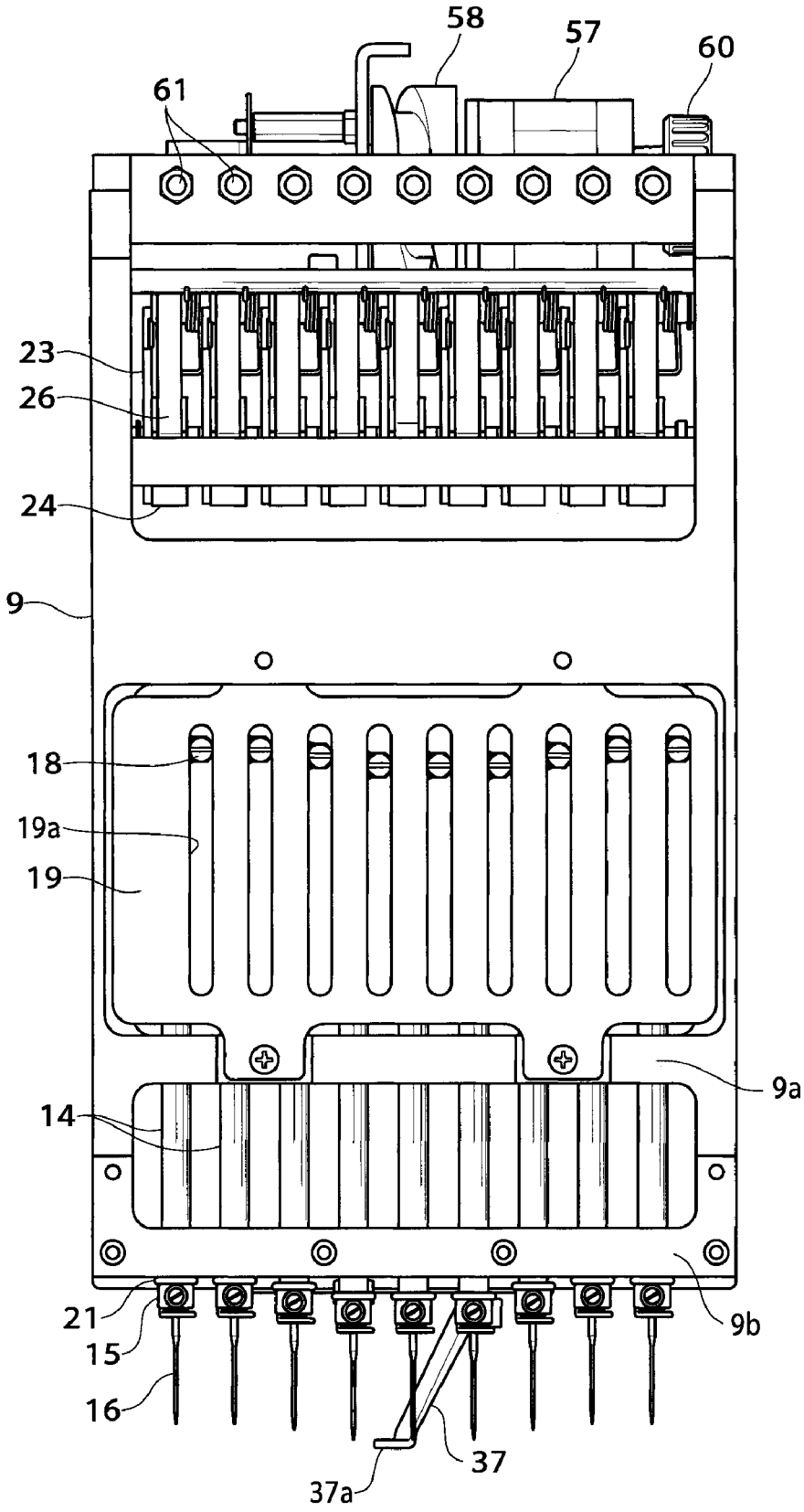
FIG. 4 is a front view of the embroidering head employed in the embodiment.

FIG. 3 is a sectional left side view showing in enlarged scale one of the embroidering heads (machine heads) H employed in the instant embodiment, and FIG. 4 is a front view of the embroidering head H. The embroidering head H includes an arm 8 fixed to the upper frame 2, and a needle bar case 9 slidably supported on the arm 2. The arm 8 is a support having various mechanical components etc. of the head H mounted and supported thereon. The needle bar case 9 is provided supported on the front surface of the arm 2 in such a manner that it is slidable, on and along a linear rail 10, relative to the arm 8 in a left-right (horizontal) horizontal direction as viewed from the front of the sewing machine. Traveling rail 11 is fixed to a lower rear surface of the needle bar case 9, and a guide roller 12 is rotatably supported on a lower end portion of a base needle bar 28 closer to the arm 8 and at a position which the traveling rail 11 abuts against. The traveling rail 11, provided on the lower rear surface of the needle bar case 9, abuts against, and is guided by, the guide roller 12 during sliding movement of the needle bar case 9. The traveling rail 11 for the needle bar case 9 is engaged by a guide member 13 provided at the lower end of the arm 8 against accidental detachment from the guide roller 12.

As seen in FIG. 4, a plurality of (nine in the illustrated example) needle bars 14 are vertically movably supported on the needle bar case 9. Sewing needle 16 is fixed to the lower end of each of the needle bars 14 via a needle clamp 15. Needle bar clamp 17 is fixed to an upper end portion of each of the needle bars 14 (see FIG. 6), and an engaging pin 18 is fixed to the needle bar clamp 17. The needle bar case 9 has fixed thereto a guide member 19 having a guide groove 19*a* corresponding to the engaging pin 18, and the engaging pin 18 is fitted in the corresponding guide groove 19*a*. Thus, rotation of the needle bar 14 about its axis can be prevented. Needle bar retaining spring 20 for normally biasing upward the needle bar 14 is provided between the needle bar clamp 17 and a horizontal frame 9*a* of the needle bar case 9. By the resiliency of the needle bar retaining spring 20, each non-restrained (i.e., non-selected) needle bar 14 is retained in its uppermost position where the needle clamp 15 is pressed, via a cushion 21, against the underside of a lower horizontal frame 9*b* of the needle bar case 9. Namely, the lower horizontal frame 9*b* functions as a stopper member defining the uppermost position or top dead point of the non-restrained (i.e., non-selected) needle bar 14. As will be later described, a presser foot 37 is provided independent of each of the needle bars 14 because it is driven via an independent presser foot driving motor. Thus, in the instant embodiment, only one presser foot 37 is provided per embroidering head H, rather than per needle bar as in the conventional multi-head embroidery sewing machines.

As seen in FIG. 3, thread take-up levers 23 are rotatably mounted on a take-up lever shaft 22, supported on the needle bar case 9, in corresponding relation to the needle bars 14. Each of the thread take-up levers 23 has a boss section 24 in which are formed a fitting groove 24*a* and engaging recessed portion 24*b*. Lock levers 26, having an engaging claws 26*a* engageable with the engaging recessed portion 24*b* of the boss sections 24 of the individual thread take-up levers 23, are rotatably provided on a support shaft 25 disposed over the take-up lever shaft 22. Each of the lock levers 26 is normally biased, via a torsion spring 27, in a clockwise direction of FIG. 3, and the engaging claw 26*a* of each of the lock levers 26 is normally engaged in the engaging recessed portion 24*b* of the boss section 24 to retain or lock the thread take-up lever 23 in a predetermined posture (top dead point position).

Figure 5:
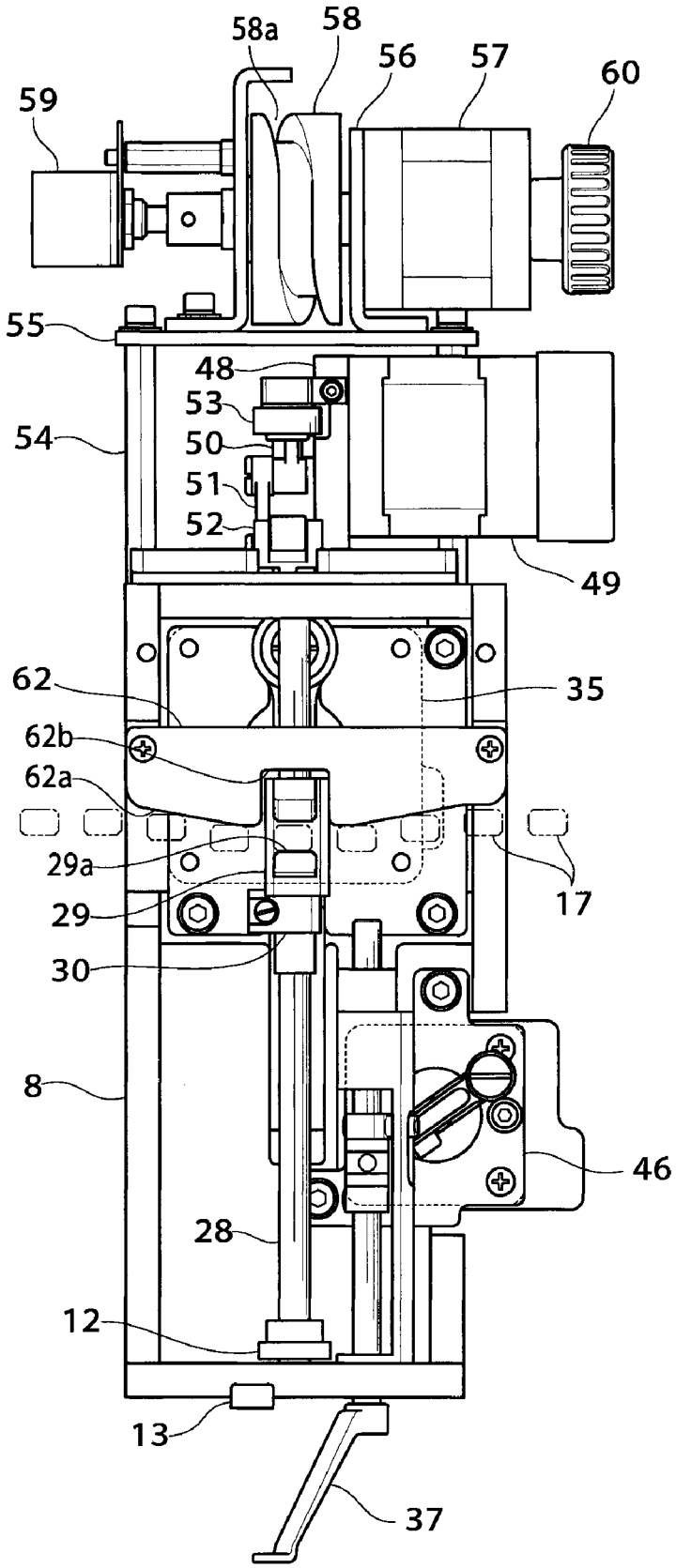
FIG. 5 is a front view of an arm (or support) of one embroidering head in the embodiment with a needle bar case removed for clarity.

FIG. 5 is a front view of the arm 8, which shows one embroidering head H with the needle bar case 9 removed for clarity. On the arm 8, there are provided a needle bar driving motor 35 for moving up and down the needle bar 14, a presser foot driving motor 46 for moving up and down the presser foot 37, a thread take-up lever driving motor 49 for pivoting the thread take-up lever 23, and a slide motor 57 for sliding the needle bar case 9. These motors 35, 49, 46 and 57 for individually driving the corresponding mechanical components, i.e. needle bar 14, thread take-up lever 23, presser foot 37 and needle bar case 9, are provided per embroidering head H.

Needle Bar Driving Mechanism

Figure 6:
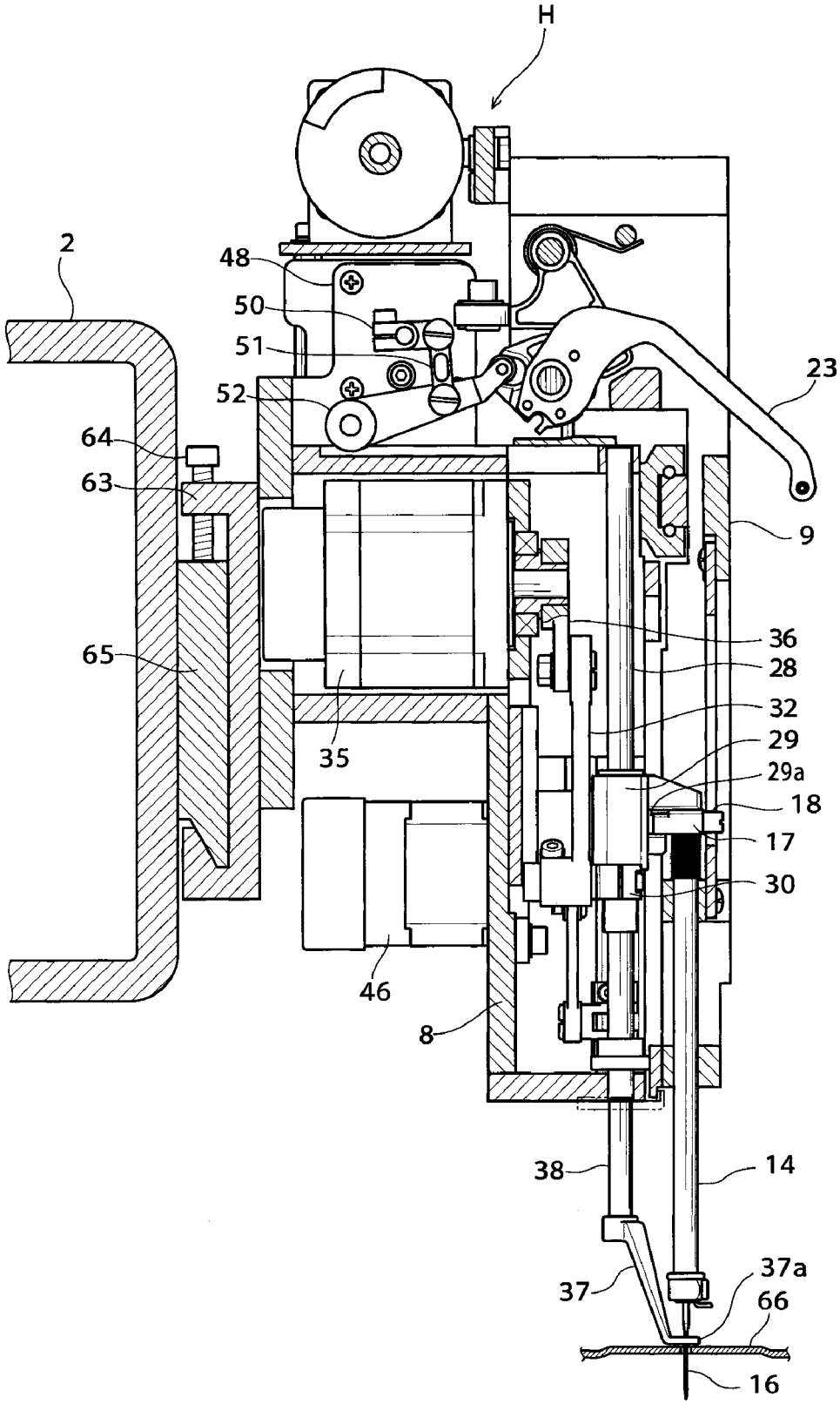
FIG. 6 is a sectional left side view, similar to FIG. 3, of the embroidering head, which particularly shows conditions of the embroidering head when a needle bar is at its bottom dead point position.

As shown in FIGS. 3, 5 and 6, one base needle bar 28 is provided in a predetermined position of the arm 8, and a needle bar drive member 29 is vertically movably provided coaxially with the base needle bar 28. The needle bar drive member 29 has an engaging recessed portion 29*a* formed therein and engageable with the needle bar clamp 17 of the needle bar 14, and a connecting member 30 is fixed to a lower end portion of the needle bar drive member 29. The connecting member 30 has a horizontal shaft portion 31 extending in a front-rear direction of the sewing machine, and one end of a connecting arm 32 is connected to the shaft portion 31. Roller 33 is provided at a rear end portion of the shaft portion 31, and the roller 33 is fitted in a vertical groove 34*a* of a guide rail 34 fixed to the arm 8 so that rotation of the needle bar drive member 29 about the axis of the base needle bar 28 can be prevented. The connecting arm 32 is pivotably connected at the other end to the distal end of a drive lever 36 that is in turn fixed to the motor shaft of the needle bar driving motor 35. Thus, as the drive lever 36 is rotated by being driven via the needle bar driving motor 35, the needle bar drive member 29 moves up and down so that the needle bar 14 whose needle bar clamp 17 is engaged in the engaging recessed portion 29*a* of the needle bar drive member 29 (i.e., the needle bar 14 positioned right in front of the base needle bar 28, namely, the currently-selected needle bar 14) is driven up and down. FIG. 3 shows condition of the machine when the needle bar 14 is in its top dead point position, while FIG. 6 shows conditions of the machine when the needle bar 14 is in its bottom dead point position.

Presser Foot Driving Mechanism

Figure 7:
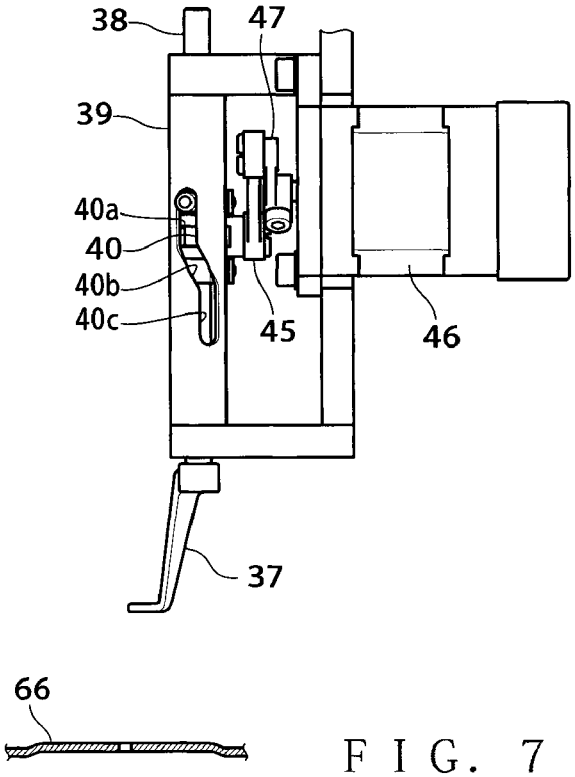
FIG. 7 is a schematic right side view showing an example of a presser foot driving mechanism mounted on the arm (or support), which particularly shows conditions of the driving mechanism when the presser foot is in its evacuated position.
Figure 8:
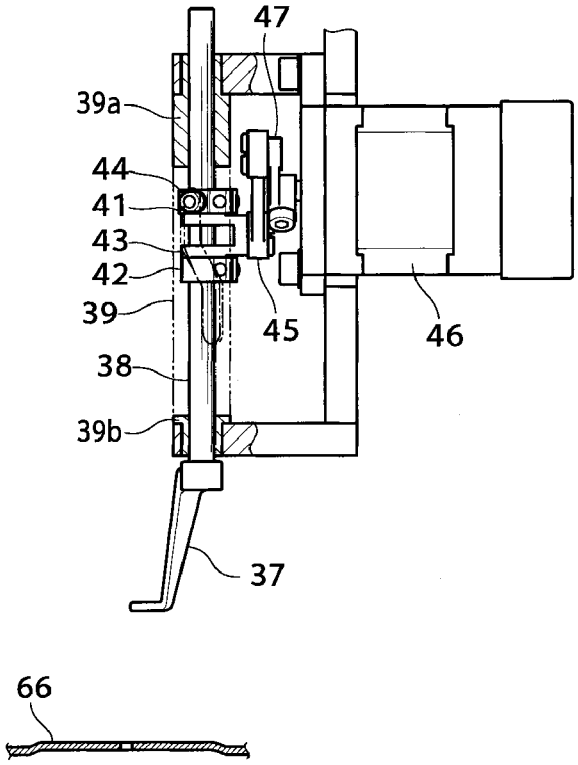
FIG. 8 is a sectional side view of the presser foot driving mechanism of FIG. 7 with parts removed for clarity.

FIG. 7 is a schematic right side view showing a presser foot driving mechanism mounted on the arm 8, and FIG. 8 is a sectional side view of the presser foot driving mechanism of FIG. 7 with parts taken away for clarity. On the arm 8, there is provided a vertically-movable rod 38 having the presser foot 37 fixed to the lower end thereof (see also FIG. 6). The vertically-movable rod 38 is supported by support portions 39*a* and 39*b*, provided at the upper and lower ends of a guide member 39 fixed to the arm 8, in such a manner that it is vertically movable and rotatable within a predetermined angular range. The guide member 39 has a guide groove 40 formed in a generally vertical middle portion thereof. The guide groove 40 has upper and lower straight portions 40*a* and 40*c*, and a slanting portion 40*b* connecting between the upper and lower straight portions 40*a* and 40*c*. A pair of positioning members 41 and 42 are fixedly to a substantial vertical middle portion of the vertically-movable rod 38, and a connecting member 43 is provided between the positioning members 41 and 42. The connecting member 43 is rotatable about the axis of the vertically-movable rod 38, and the connecting member 43 are vertically positioned by the pair of positioning members 41 and 42. Roller 44 is fixed to the positioning member 41 and engaged in the guide groove 40 of the guide member 39. Connecting arm 45 is pivotably connected at one end to the connecting member 43 and pivotably connected at the other end to a distal end portion of a drive lever 47 that is in turn fixed to the motor shaft of the presser foot driving motor 46. Thus, as the drive lever 47 pivots by being driven via the presser foot driving motor 46, the presser foot 37 is moved up and down together with the vertically-movable rod 38.

Figure 9:
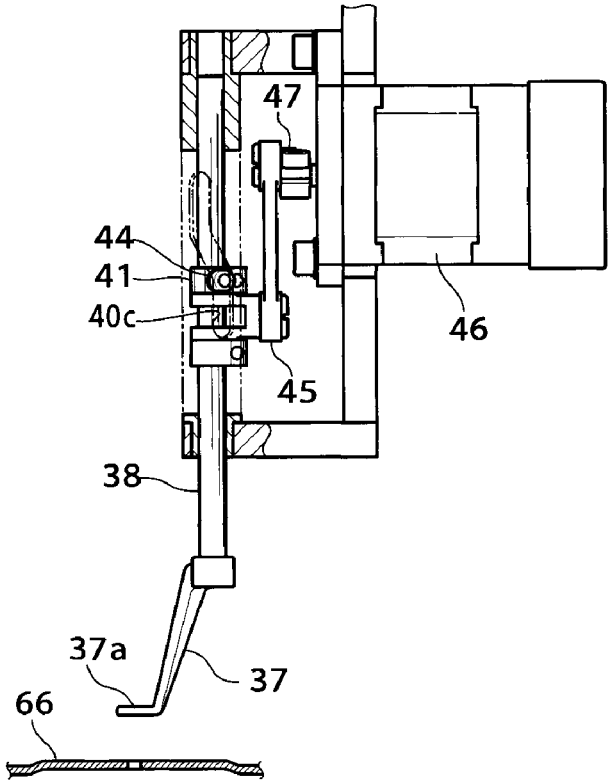
FIG. 9 is a sectional side view of the presser foot driving mechanism, which particularly shows conditions of the driving mechanism when the presser foot is in its top dead point position.
Figure 10:
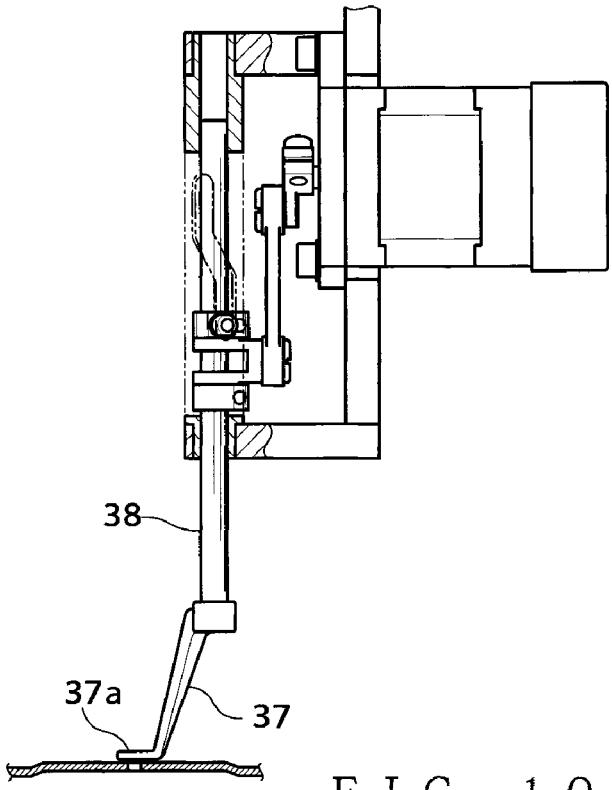
FIG. 10 is a sectional side view of the presser foot driving mechanism, which particularly shows conditions of the driving mechanism when the presser foot is in its bottom dead point position.

FIGS. 7 and 8 show the presser foot 37 in its evacuated position, and FIG. 9 shows the presser foot 37 in its top dead point position. In an embroidery operation, the presser foot driving motor 46 is controlled to repetitively rotate reciprocatively (in forward and reverse direction) within a predetermined rotational angle range in synchronism with a sewing operation, so that the presser foot 37 is reciprocatively driven up and down between the top dead point position shown in FIG. 9 and the bottom dead point position shown in FIG. 10. During that time, the roller 44 of the upper positioning member 41 slides up and down in and along the lower straight portion 40*c* of the guide groove 40, and a conventionally-known needle hole formed in a sole portion 37*a*, disposed at the lower end of the presser foot 37, is kept in alignment with a sewing needle 16 of the selected needle bar 14.

Upon termination of the embroidery operation or when the embroidering head H is to be brought to a resting position, the presser foot driving motor 46 is controlled to rotate to a predetermined rotational position outside the above-mentioned predetermined rotational angle range, so that the presser foot 37 is moved to a predetermined evacuated position (see FIG. 3 or 7). Namely, in accordance with the rotation of the presser foot driving motor 46 toward the predetermined rotational position, the roller 44 of the upper positioning member 41 moves upward, beyond the top dead point position shown in FIG. 9, all the way to the upper end of the upper straight portion 40*a* by way of the slanting portion 40*b* (see FIG. 7 or 8). During such upward movement of the roller 44 along the slanting portion 40*b*, the vertically-movable rod 38 (presser foot 37) rotates about its axis through a predetermined angle, so that the sole portion 37*a* (needle hole) of the presser foot 37 is moved leftwardly and rearwardly of the sewing needle 16 (see FIG. 3 or 4) and thus takes a position as shown in FIGS. 7 and 8. With the presser foot 37 held in such an evacuated position, sliding movement of the needle bar case 9 is effected to select a desired one of the needle bars 14. Thus, during the sliding movement of the needle bar case 9 for selection of a desired one of the needle bars 14, the sole portion 37*a* (needle hole) of the presser foot 37 can be prevented from interfering with the distal end of the sewing needle 16 so that safety can be ensured. Note that the components (39, 40, 41, 42, 43, 44, 45, 47, etc.) involved in conversion of the rotation of the presser foot driving motor 46 into a desired motion of the presser foot 37 via the roller 44 together constitute a motion conversion mechanism.

Thread Take-Up Lever Driving Mechanism

As shown in FIGS. 3, 5 and 6, the thread take-up lever driving motor 49 is fixed to an upper end portion of the arm 8 via a bracket 48, and a drive lever 50 is fixed to the motor shaft of the take-up lever driving motor 49. Connecting arm 51 is pivotably connected at one end to a distal end portion of the drive lever 50, and the connecting arm 51 is connected at the other end to a substantial longitudinal middle portion of a drive arm 52 pivotably supported on the bracket 48. The drive arm 52 has its distal end fitted in the fitting groove 24*a* of the thread take-up lever 23 corresponding to the selected needle bar 14. Roller 53 is supported on the bracket 48 and abuttable against a projection 26*b* of the lock levers 26 corresponding to the selected needle bar 14. By the roller 53 abutting against the projection 26*b*, the lock lever 26 pivots counterclockwise, so that the engaging claw 26*a* of the lock lever 26 disengages from the engaging recessed portion 24*b* of the boss section 24 and thus the thread take-up lever 23 is released from a locked state. Thus, as the thread take-up lever driving motor 49 is activated, one thread take-up lever 23 corresponding to the selected needle bar 14 is driven to pivot.

Thread Color Change (i.e., Selective Needle Bar Movement) Mechanism

As illustratively shown in FIG. 5, a plate 55 is fixed to an upper end portion of the arm 8 via a plurality of studs 54, and a bracket 56 is fixed to the plate 55. Motor (two-axis motor) 57 for sliding the needle bar case 9 is fixed to the bracket 56. As seen in FIG. 5, a drive cam 58 is fixed to the motor shaft projecting leftwardly from the motor 57, and a rotational position detector (e.g., potentiometer) 59 is provided at the distal end of the motor shaft of the motor 57. As further seen in FIG. 5, a knob 60 for manual operation by a human operator is fixed to the motor shaft projecting rightwardly from the motor 57. The drive cam 58 has a cam groove 58*a* formed therein, and the cam groove 58*a* opens at opposite end portions of the drive cam 58. As seen in FIGS. 4 and 6, one of rollers 61, fixed to a rear upper end portion of the needle bar 9, engages with the cam groove 58*a*. More specifically, the rollers 61 are provided in corresponding relation to the needle bars 14, and the roller 61 corresponding to the selected needle bar 14 engages with the cam groove 58*a*. As the needle bar case driving (i.e., sliding) motor 57 is activated to rotate the drive cam 58, the roller 61 engaging with the cam groove 58*a* slides in the left-right direction and disengages from one of the end openings of the cam groove 58*a*. Then, another one of the rollers 61, adjoining the above-mentioned roller 61, is brought into engagement with the cam groove 58*a* via the other end opening of the cam groove 58*a*. In the aforementioned manner, the mutually-adjoining rollers 61 sequentially engage with the cam groove 58*a* by activation of the needle bar case driving motor 57, and sliding movement of the needle bar case 9 is effected so that a desired one of the needle bars 14 is selected. During that time, it is possible to detect, on the basis of a detection signal from the rotational position detector 59, which one of the needle bars 14 is currently selected. Namely, any desired one of the needle bars 14 can be selected through control of the rotation amount of the motor 57.

As further seen in FIG. 5, a guide plate 62 is fixed to a substantial vertical middle portion of the front surface of the arm 8. The guide plate 62 has a lower slanting surface 62*a* slanting downwardly from opposite horizontal ends toward a substantial horizontal middle of the plate 62. Recessed portion 62*b* is formed, in a substantial horizontal middle portion of the lower slanting surface 62*a*, to prevent interference with the needle bar drive member 29. The needle bar clamp 17 of the needle bar 14 abuts against the lower slanting surface 62*a* of the guide plate 62, to thereby define the vertical position of the needle bar clamp 17 (needle bar 14). As noted above, each non-restrained (i.e., non-selected) needle bar 14 is retained, by the resiliency of the needle bar retaining spring 20, in the uppermost position where its needle clamp 15 is pressed, via the cushion 21, against the underside of the lower horizontal frame (stopper member) 9*b* of the needle bar case 9. However, as clearly seen from FIG. 3, the top dead point of the selected needle bar 14 is set to agree with the position of the needle bar drive member 29 so that a gap is formed between the cushion 21 and the underside of the lower horizontal frame 9*b*. Thus, the cushion 21 abuts against the underside of the lower horizontal frame 9*b* as the needle bar 14 moves up and down, which can avoid unwanted spattering of lubricant oil having fallen along the needle bar 14. In FIG. 5, the needle bar clamp 17 of each of the needle bars 14 is indicated by an imaginary line. As clearly seen from the figure, the slanting surface 62*a* of the guide plate 62 functions to guide the needle bar clamp 17 of the selected needle bar 14 so that the upper limit position of the needle bar clamp 17 aligns with the engaging recessed portion 29*a* of the needle bar drive member 29. Because the needle bar case 9 can be driven independently per embroidering head H in the above-described manner, the aforementioned inventive arrangements are suited for later-described modulization of each of the embroidering heads (machine heads) H, but also allow a different needle bar (color thread) to be selected per embroidering head H.

Modulization of Embroidering Head H

In each of the embroidering heads H employed in the instant embodiment, as set forth above, not only various mechanical components, such as the needle bars 14, thread take-up levers 23, presser foot 37 and needle bar case 9, but also the motors 35, 49, 46 and 57 for individually driving the mechanical components are mounted and supported on the arm (support) 8. Thus, each of the embroidering heads H does not have complicated mechanismic connections like those present in the conventionally-known sewing machines, and thus, it can be handled as an independent module. Namely, the modulized embroidering head H with the arm (support) 8 can be attached and detached, as one integral unit, to and from the upper frame 2 of the sewing machine without the mechanisms and other devices having to be diassembled. Thus, in the event a certain component in any of the embroidering heads H has broken down or failed, the whole failed embroidering head H can be readily detached and replaced, as an integral unit, with another, normal embroidering head H. Therefore, the construction of each of the embroidering heads H is suited for replacement or repair of any of its component parts, and thus, at the time of repairing the failure, the sewing machine only has to be deactivated for a time just necessary for replacement of the embroidering head H, which can minimize the time over which inconveniences are caused to the user (i.e., over which the sewing machine has to be shut down or deactivated). Further, as will be later explained in detail, the inventive arrangements allow one type of embroidering head H to be replaced readily and freely with another type of embroidering head H in the same sewing machine, so that the sewing machine can be used very efficiently by, for example, switching between a normal sewing (lock-stitching) head and a handwheel-operated (lock-stitching) head (or handwheel-operated lock-stitching machine head capable of sewing a string-shaped material, such as a tape or cord, onto a fabric).

Example Structure for Positioning Modulized Embroidering Head

Figure 11:
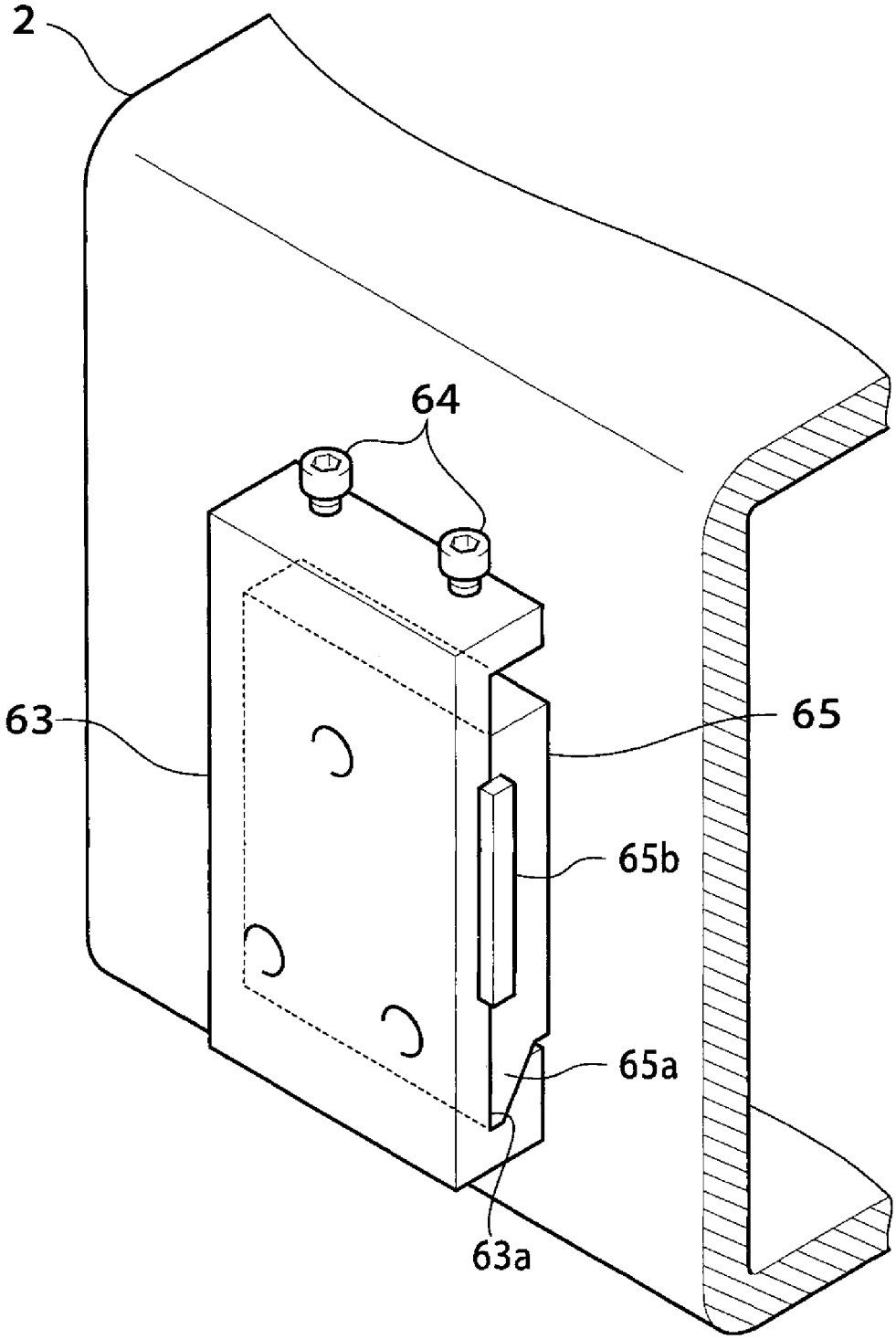
FIG. 11 is a fragmentary perspective view showing a structure for positioning a modulized embroidering head for mounting to a machine frame.

In FIGS. 3 and 6, there are shown in section an example structure for not only allowing the embroidering head H, modulized in the aforementioned manner, to be readily attached and detached to and from the upper frame 2 but also allowing the modulized embroidering head H to be accurately positioned relative to the upper frame 2. FIG. 11 is a fragmentary perspective view showing such a structure for positioning the embroidering head H. As shown in these figures, a fixation member 63 of a channel-like sectional shape is fixed to the reverse side of the arm (support) 8 of the embroidering head H. The fixation member 63 has an oblique guide recess 63*a* formed in its lower end region, and mounting screws 64 can be screwed into upper end portions of the fixation member 63. Base members 65 are fixed to the upper frame 2 of the sewing machine at positions corresponding to predetermined positions where the individual embroidering heads H are to be mounted. Each of the base members 65 has, on its lower end portion, an engaging projection 65*a* corresponding in position and shape to the above-mentioned guide recess 63*a* of the fixation member 63 fixed to the arm 8. As clearly seen from FIG. 11, the base member 65 has, on its right side surface, a positioning portion 65*b* abutting against a side surface of the fixation member 63 fixed to the arm 8. By attaching the fixation member 63, fixed to the reverse side of the arm 8, to the base member 65, the embroidering head H is fixed to the upper frame 2 of the sewing machine. The fixation member 63 can be fixed after having been appropriately positioned in the front-rear and left-right directions, by the guide recess 63*a* being fitted over the engaging projection 65*a* of the base member 65 from below and the mounting screws 64 being tightened with one side surface of the fixation member 63 abutted against the positioning portion 65*b*. In this way, positioning of the embroidering head H to be fixedly mounted on the upper frame 2 can be facilitated. Needless to say, the structure for positioning the modulized embroidering head H for mounting on a predetermined position of the upper frame 2 is not limited to the illustrated example, and it may be any other suitable structure, such as a simple bolting structure or a structure employing a desired jig etc.

Control System

FIG. 2 is a block diagram illustrating an example control system of the multi-head embroidery sewing machine according to the instant embodiment. Various operations of the multi-head embroidery sewing machine are controlled by a computer that comprises a CPU (Central Processing Unit) 200, program memory (ROM and/or RAM) 201, working RAM 202 and data RAM 203. Control program for carrying out the present invention and various operation control programs are prestored in the program memory 201 and executed by the CPU 200. Operation panel box 204 includes operation switches 205 operable to make various settings, selections, instructions, touch panel 206, display 207, etc. Memory drive 208 controls reading and writing operations of a storage device that is, for example, in the form of a hard disk and/or a removable storage medium, such as a flexible disk. The control program for carrying out the present invention and various operation control programs may be prestored in the storage device of the memory drive 208. Embroidery sewing data representing various embroidery patterns may be prestored in the removable storage medium, such as a flexible disk. Such a removable storage medium is set in the memory drive 208 and read by the CPU 200. To the computer 209 are connected, via interfaces (IFs), the aforementioned operation panel box 204, memory drive 208, drivers and controllers for driving and controlling various mechanisms of the sewing machine and start/stop switch 216. In FIG. 2, there are shown only some of the drivers and controllers (210-215), for convenience of illustration, with the other drivers and controllers omitted.

The embroidery frame driver 210 is a circuit for controlling the driving by the X-axis motor 7X and Y-axis motor 7Y that drive the embroidery frame 7, provided for holding an embroidering workpiece, in the X and Y directions. As well known in the art, the driving by the X-axis motor 7X and Y-axis motor 7Y is controlled, in synchronism with the stitch-by-stitch sewing operation, in accordance with a stitch-by-stitch sewing pattern (sewing widths and directions) representing sewing pattern data of an embroidery pattern.

Rotary hook driver 211 is a circuit for performing control to rotationally drive the hook driving motor 6. As set forth above, rotation of the hook drive shaft 5, transmitting the driving force of the hook driving motor 6 to each of the rotary hooks 3, is detected by the encoder 3E.

The head-specific controllers 212, 213 and 214 each comprehensively represent driver/control circuitry for the separate or individual motors corresponding to the various mechanical components provided for the associated head. Namely, the controller 213, for example, includes circuits for individually controlling the motors (35, 49, 46, 57, etc.) that individually drive various mechanical components (such as the needle bar 14, thread take-up lever 23, presser foot 37 and needle bar case 9) provided in the associated embroidering head H, as well as circuits for controlling the detection by rotational position detectors (not shown) provided in corresponding relation to the motors. In controlling the driving by the motors, detection signals of the rotational position detectors (not shown) are used, as necessary, as well known in the field of the motor control. Whereas only three controllers 212, 213 and 214 are shown for convenience of illustration, such controllers are actually provided in corresponding relation to the embroidering heads H in the sewing machine. In the illustrated example, the driving by the motors (35, 49, 46, 57, etc.), which individually drive the various mechanical components (such as the needle bar 14, thread take-up lever 23, presser foot 37 and needle bar case 9) provided in the associated embroidering head H, is controlled individually by the controller 212, 213, 214. Of course, the driving by the individual motors in each of the embroidering heads H is controlled in synchronism with the sewing operation. However, in the sewing machine of the present invention, which is not equipped with the main shaft as employed in the conventionally-known sewing machines, it is not possible to perform sewing-operation synchronization control based on the main shaft's rotational angle as performed in the conventionally-known sewing machines.

Example of Control Performed

In order to individually control the driving by the motors (35, 49, 46, 57, etc.), which individually drive the various mechanical components (such as the needle bar 14, thread take-up lever 23, presser foot 37 and needle bar case 9) provided in each of the embroidering heads H, in respective desired forms, content of control and behavior and conditions of the control of the individual motors are set in accordance with the desired forms of control. For that purpose, desired settings may be directly made, per motor of each of the embroidering heads H, using the operation switches 205 etc. of the operation panel box 204. Alternatively, at the time when embroidery sewing pattern data are created via a separate setting device, content of control and behavior and conditions of the control and behavior of the individual motors may be set as desired. In the latter case, data indicative of the settings of the content of control and behavior and conditions of the individual motors are read out from a storage medium and set into the corresponding controllers 212, 213, 214.

As one example way of setting the content of control of the motors 35, 49 and 46 for individually driving the mechanical components directly involved in stitch-by-stitch sewing, such as the needle bar 14, thread take-up lever 23 and presser foot 37, the user may set respective desired operating motion trajectories (time-vs.-position trajectories), in each one-stitch sewing operation, of the mechanical components. For example, the user may be allowed to set, as desired, operating motion trajectories of the mechanical components; for such a purpose, the user may, for example, make settings to slightly expedite the operating motion of the thread take-up lever 23 (in this case, errors at the beginning of sewing can be reduced), or may make settings to start driving of the thread take-up lever 23 after the upper thread and under (bobbin) thread have entwined with each other. In such a case, the setting operation can be performed with ease if a plurality of different kinds of information for setting trajectories, during the sewing operation, of the mechanical components are prestored so that the user can select desired trajectories from among the prestored trajectories. The operation for setting the operating motion trajectories of the individual mechanical components may be performed independently per embroidering head H in accordance with a specific purpose of the embroidery sewing, or common setting operation may be applied to all of the embroidering heads H.

The following paragraphs describe further detailed examples of settings.

(1) In a Case Where Embroidery Sewing of the Same Quality is to be Performed on Every Embroidering Head H:

In this case, the driving control on the motors for the various mechanical components (such as the needle bar 14, thread take-up lever 23, presser foot 37 and needle bar case 9) is performed commonly in all of the embroidering heads H, as with the conventionally-known embroidery sewing control. Because the above-described inventive arrangements can eliminate the problems of the twisting of the drive shafts, operational time differences between the needle and the rotary hook and desynchronization of the thread take-up lever, the instant embodiment of the present invention allows embroidery sewing of the same quality to be performed simultaneously on every embroidering head H without finished quality of the products being impaired.

(2) In a Case Where Sewing Workpieces of Different Materials are Set on the Individual Embroidering Heads H:

According to the present invention, the material of sewing workpieces to be set on the holding frame 7 in correspondence with the embroidering heads H can be differentiated among all of the embroidering heads H or differentiated between at least one of the embroidering heads H and the other embroidering heads H. For example, thick fabric can be set on the holding frame 7 in correspondence with one embroidering head H, thin fabric set in correspondence with another embroidering head H, and leather set in correspondence with still another embroidering head H. In such a case, embroidery sewing of the same pattern (outline of the embroidery) can be performed concurrently on all of the embroidering heads H because the holding frame 7 is driven in the X and Y directions in accordance with a common embroidery sewing pattern. In such a case, of course, the sewing workpieces of different materials are set on respective small head-specific embroidery frames (not shown), and then these head-specific embroidery frames with the sewing workpieces are set on the greater-size holding frame 7 and driven together in the X and Y directions. The concurrent embroidery sewing on the individual sewing workpieces of different materials means that small-lot production of a wide variety of embroidery products can be achieved with an enhanced efficiency.

That sewing workpieces of different materials are set on the holding frame 7 in correspondence with the embroidering heads H means that needle insertion/pull-out resistance etc. differs depending on the materials of the workpieces, and thus, in this case, it is necessary to individually set operating motions of the presser foot and needle bar in accordance with the characteristics of the materials of the embroidering workpieces. The instant embodiment of the present invention can satisfy such a need, i.e. can individually set operating motions of the presser foot and needle bar per embroidering head H in accordance with the material characteristics of the corresponding embroidering workpiece. In this way, the instant embodiment can provide appropriate embroidered products on all of the embroidering heads even in the case where the sewing workpieces set on the holding frame 7 in correspondence with the embroidering heads H differ from one another in material.

(3) In a Case Where Characteristics of an Upper Thread are Differentiated Among the Individual Embroidering Heads H:

According to the instant embodiment of the present invention, characteristics (thickness, degree of stretchability, etc.) of the upper thread used in each of the embroidering heads H can be differentiated from characteristics of the upper threads used in the other embroidering heads H, or characteristics of the upper thread used in at least one of the embroidering heads H can be differentiated from characteristics of the upper threads used in the other embroidering heads H. In such a case too, embroidery sewing of the same pattern (outline of an embroidery) can be performed concurrently on all of the embroidering heads H because the holding frame 7 is driven in the X and Y directions in accordance with a common embroidery sewing pattern. However, with the differences in the characteristics of the upper threads used, the instant embodiment can concurrently provide embroidery products differing in texture among the embroidering heads H. The concurrent embroidery sewing with the different characteristics of the upper threads means that small-lot production of a wide variety of embroidered products can be achieved with an enhanced efficiency. That the upper threads used for the embroidery sewing have different characteristics (e.g., different thicknesses, stretchabilities, etc.) means that, in order to permit appropriate embroidery sewing on the individual embroidering heads H, it is necessary to individually set an operating motion of the thread take-up lever of each of the heads H in accordance with the characteristics of the upper thread used. The instant embodiment of the present invention can satisfy such a need, i.e. can individually set, per machine head H, an operating motion of the thread take-up lever in accordance with the characteristics of the upper thread used. In this way, the instant embodiment can provide appropriate embroidered products on all of the embroidering heads even in the case where the characteristics of the upper thread are differentiated among the individual embroidering heads H.

(4) In a Case Where the Needle Bar Selection are Differentiated Among the Individual Embroidering Heads H:

In the instant embodiment, where the motor 57 for driving the needle bar case 9 can be controlled individually per machine head H, it is possible to select a different needle bar (i.e., color thread) per machine head H, in which case embroidery sewing of the same pattern (i.e., outline of an embroidery pattern) can be performed concurrently on all of the embroidering heads H using different color threads. Alternatively, the color thread used in at least one head H may be differentiated from the color thread used in the other heads H. In this case too, small-lot production of a wide variety of embroidered products can be achieved with an enhanced efficiency.

(5) Improvement in the Finished State Through Adjustment of a Needle bar Driving Pattern:

By appropriately setting a driving pattern (trajectory) of the needle bar driving motor 35 per machine head H, the stroke position of the needle bar relative to the rotational angle of the rotary hook 3 can be varied per machine head H. In this way, a desired finished state can be achieved individually for each of the heads H, or a common desired finished state can be achieved for all of the heads H.

(6) Needle Bar Jump Control:

With the instant embodiment, where a driving pattern (trajectory) of the needle bar driving motor 35 can be set individually for each of the heads H as noted above, the so-called "jump control", intended to bring only a desired head H into a resting (non-operating) position, can be performed with ease without provision of a particular jump mechanism as provided in the conventionally-known sewing machines. Thus, with the instant embodiment, the so-called "jump stitch", which has heretofore been formed by needle bar jump control, can be readily formed as desired. Namely, with the aforementioned arrangement that a driving pattern (trajectory) of the needle bar driving motor 35 is set per machine head H, it is possible to increase a driven time length of the embroidery frame (support frame) 7 for a desired stitch by increasing the time over which a selected one of the needle bars (sewing needles) is to be kept raised away from the surface of the sewing workpiece; thus, a longer stitch can be formed without the number of machine rotations (or rotations of the corresponding rotary hook 3) being changed. In addition, because some time margin can be set to the driven time length of the embroidery frame (support frame) 7 for a desired stitch, the moving speed of the embroidery frame (support frame) 7 can be lowered in view of the material, characteristics etc. of the sewing workpiece (e.g., fabric).

(7) Adjustment of the Vertical Movement Stroke of the Needle Bar:

Whereas a rotary motor is used as the needle bar driving motor 35 of each of the heads H in the described instant embodiment, a linear motor may alternatively be used, in which case the vertical movement stroke of the needle bar 14 can be adjusted as desired. For example, in a case where a boring knife is attached to the lower end of the needle bar, a penetrating depth with which the boring knife is caused to penetrate the sewing workpiece (e.g., fabric) can be adjusted through adjustment of the vertical movement stroke of the needle bar 14 having the knife attached thereto. Further, because the vertical movement stroke of the needle bar 14 can be adjusted as desired, vibration and sound noise of the sewing machine can be reduced by reducing the movement stroke, in a case where embroidery is to be performed at high speed. Thus, the instant embodiment permits an embroidery operation with high-speed rotations that has never been achievable by the conventionally-known sewing machines.

(8) Motion Adjustment of the Thread Take-Up Lever:

In the instant embodiment, a desired driving pattern (trajectory) of the thread take-up lever driving motor 49 can be set per machine head H. Thus, the instant embodiment can reliably prevent unwanted slip-off of the thread at the beginning of sewing by appropriately adjusting the operating motion of the thread take-up lever at the beginning of the sewing, thereby avoiding errors at the beginning of the sewing. Further, by appropriately adjusting the operating motion of the thread take-up lever per machine head H, the instant embodiment can appropriately deal with, per machine head H, so-called "looping" where the upper thread loops at the back of the sewing workpiece (e.g., fabric), or insufficient tightness of a stitch. For example, the instant embodiment can hasten, arrival at the top dead point, of the thread take-up lever so that pull-up, by the take-up lever, of the upper thread can be completed earlier; as a result, sufficient tightness of the stitch can be ensured. In the conventionally-known sewing machines, where there is only a little time margin from the pull-out to next insertion of the sewing needle, movement of the embroidery frame for a next stitch has to be started prior to completion of formation of the preceding stitch, which may adversely influence the finished state. On the other hand, the instant embodiment, which is arranged to hasten arrival, at the top dead point, of the thread take-up lever so that pull-up, by the take-up lever, of the upper thread can be completed earlier, can hasten the timing to tighten the thread and thereby significantly improve the finished state of an embroidery product. Further, by adjusting the stroke of the thread take-up lever per stitch in accordance with the stitch length on the basis of embroidery data, namely, by increasing the stroke of the thread take-up lever per in proportion to the stitch length, the instant embodiment can also avoid unwanted shrinkage of the sewing workpiece.

(9) Adjustment of a Driving Pattern of the Presser Foot:

By appropriately setting a driving pattern (trajectory) of the presser foot driving motor 46 per machine head H, the operating motion of the presser foot 37 of each head H can be advanced or retarded relative to the operating motion of the needle 16 in the instant embodiment. Thus, in performing, for example, three-dimensional embroidery (where a three-dimensional material of a desired shape is put on a sewing workpiece and then sewn to the sewing workpiece from above), the instant embodiment can vary the state of the embroidery sewing and achieve an enhanced finished state of the embroidery product. Further, in a case where a relatively great resistance is encountered when the sewing needle 16 gets out of an embroidering (sewing) workpiece as the needle bar moves up, as in three-dimensional embroidery, the instant embodiment performs control to retard the moving-up timing of the presser foot 37 so that the presser foot 37 can sufficiently press the embroidering workpiece until the sewing needle 16 completely gets out of the workpiece. Further, by appropriately adjusting the stroke of the presser foot 37 (e.g., reducing the stroke at the time of sewing), the instant embodiment can achieve reduced operating sound and speeded-up operation.

Modification of Thread Color Change (i.e., Selective Needle Bar Movement) Mechanism Unlike the other mechanical components, the thread color change (selective needle bar movement) mechanism is not operated in synchronism with the stitch-by-stitch sewing operation. Thus, even if the separate needle bar case driving (or sliding) motor 57 is not provided per machine head H, it does not substantively influence the finished state of an embroidered product. However, if the needle bar case driving motor 57 is provided per machine head H as in the above-described embodiment, modulization of the heads H can be achieved effectively. Modification of the thread color change (selective needle bar movement) mechanism, which will be described below with reference to FIG. 12, permits modulization of the embroidering head H without the separate needle bar case driving motor 57 being provided per machine head H.

Figure 12:
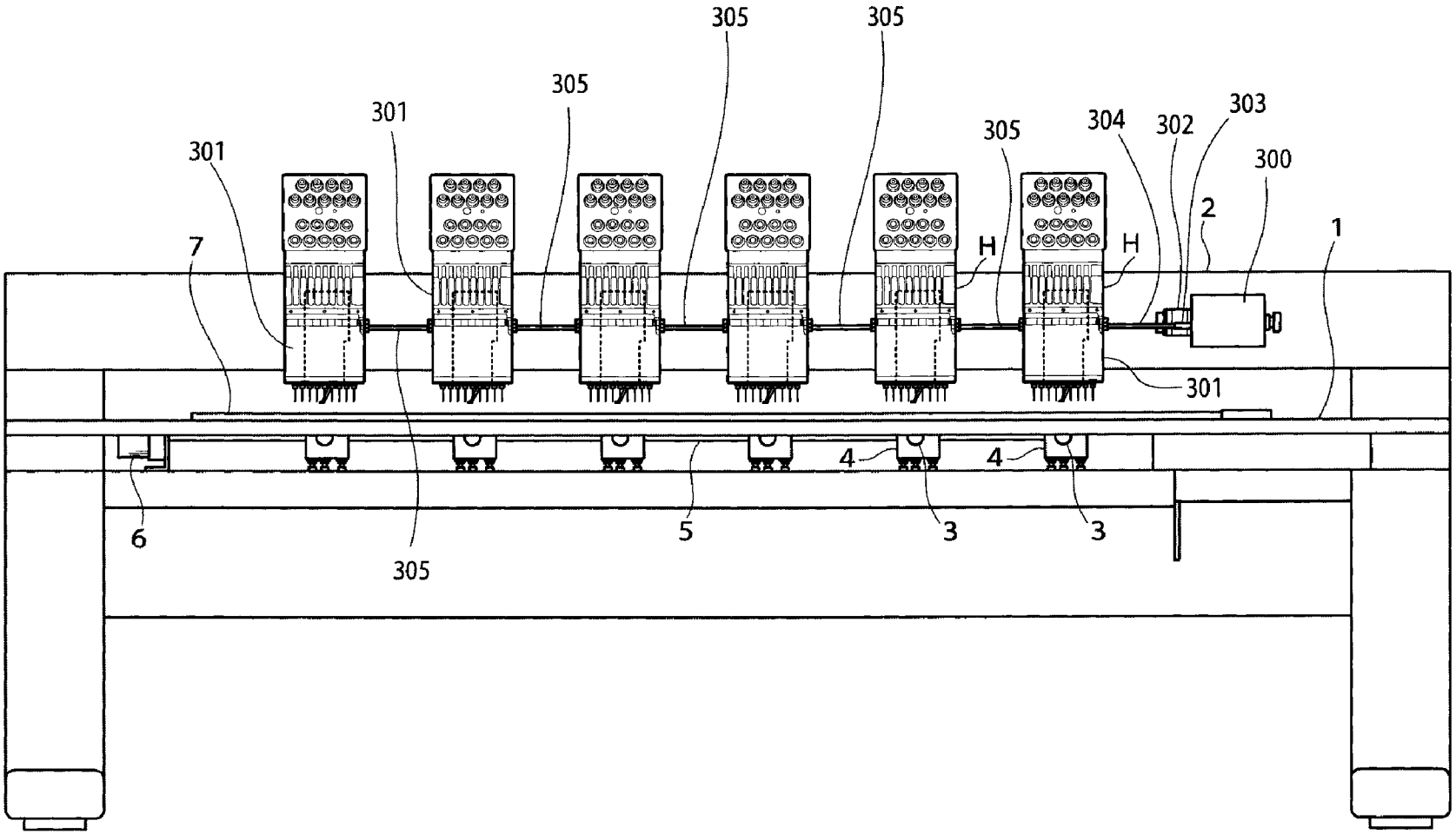
FIG. 12 is a front view of the multi-head embroidery sewing machine, which particularly shows a modification of a thread color change (selective needle bar movement) mechanism.

In a multi-head embroidery sewing machine shown in FIG. 12, the separate needle bar case driving motor 57, constructed in the above-described manner is not provided per machine head H, and just one needle bar case driving (sliding) mechanism 300 is provided to slide needle bar cases 301 of the individual heads H in an interlocked fashion as in the conventionally-known sewing machines. The needle bar case driving mechanism 300 itself may be constructed in the conventionally-known manner, and thus, the construction of the mechanism 300 is not illustrated in detail. As shown, the needle bar case driving (sliding) mechanism 300 includes a cam coupled to the rotation shaft of a motor 302 and a cam follower, and rotation of the cam responsive to the rotation of the motor 302 is converted into a linear sliding motion of the cam follower. For example, the cam has a helical groove in its cylindrical peripheral surface, and the cam follower is slidably engaged in the helical groove. Rod 303 extending from the cam follower is coupled to a connecting rod 304 that connects to the needle bar case 301. Further, the respective needle bar cases 301 of the heads H are interconnected via connected rods 305. Thus, as the motor 302 rotates through a predetermined angle (e.g., 360 degrees or one rotation), the cam follower slides by a predetermined amount, in response to which the rod 303 slides so that, via the connecting rods 304 and 305, the needle bar cases 301 of the heads H are caused slide together by one pitch of the needle bar arrangement or array in the needle bar case. Thus, a desired one of the needle bars can be selected by rotating the motor 302 of the needle bar case driving mechanism 300 to a position corresponding to the position of the needle bar to be selected. Here, the connecting rods 304 and 305 are each detachably provided independently of the module of the head H. Therefore, when any one of the machine heads H is to be detached, only the connecting rod 304 or 305 connected to the needle bar case 301 of the head H has to be detached. Thus, by the provision of the detachable connecting rods 304 and 305, the embroidering heads H can be modulized without the separate needle bar case driving motor (57) being provided per machine head H.

Handwheel-Operated Lock-Stitching Head

In the above-described embodiment of the present invention, the heads H are each in the form of a "lock-stitch sewing head" that performs ordinary sewing. However, the basic principles of the present invention are applicable not only to such a lock-stitch sewing head but also to any other types of sewing heads. For example, the rotary hook 3 used for lock-stitch sewing can be used as is even in a case where a "handwheel-operated lock-stitching head" is used for performing decorative sewing of a string-shaped (or strand-like) material or the like. Therefore, through modulization of the handwheel-operated lock-stitching head, it becomes possible to perform both ordinary sewing and decorative sewing by switching, as necessary, between different types of modulized heads (e.g., "lock-stitch sewing head" and handwheel-operated lock-stitching head).

Figure 13:
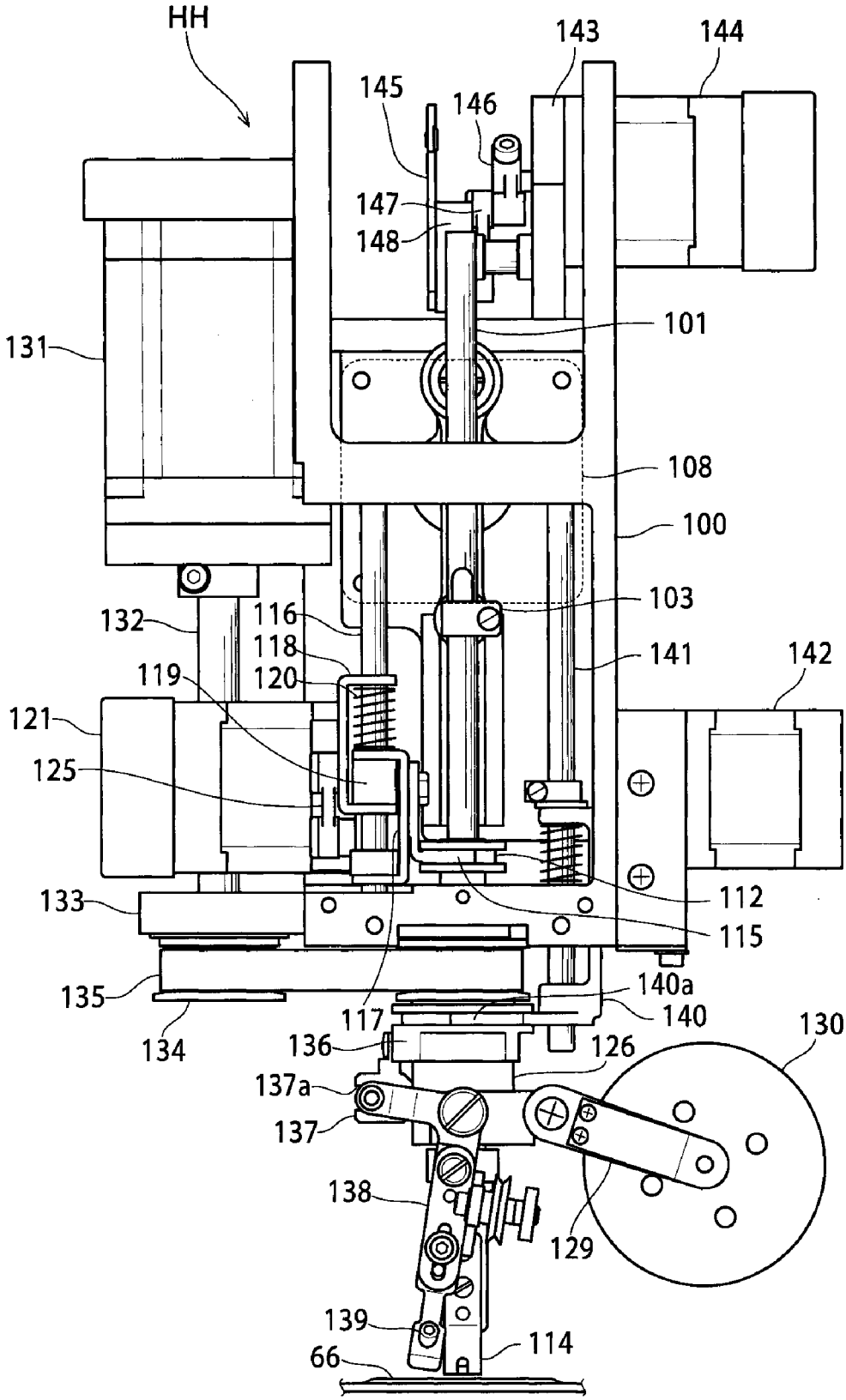
FIG. 13 is a front view of a handwheel-operated lock-stitching head in accordance with an embodiment of the present invention.
Figure 14:
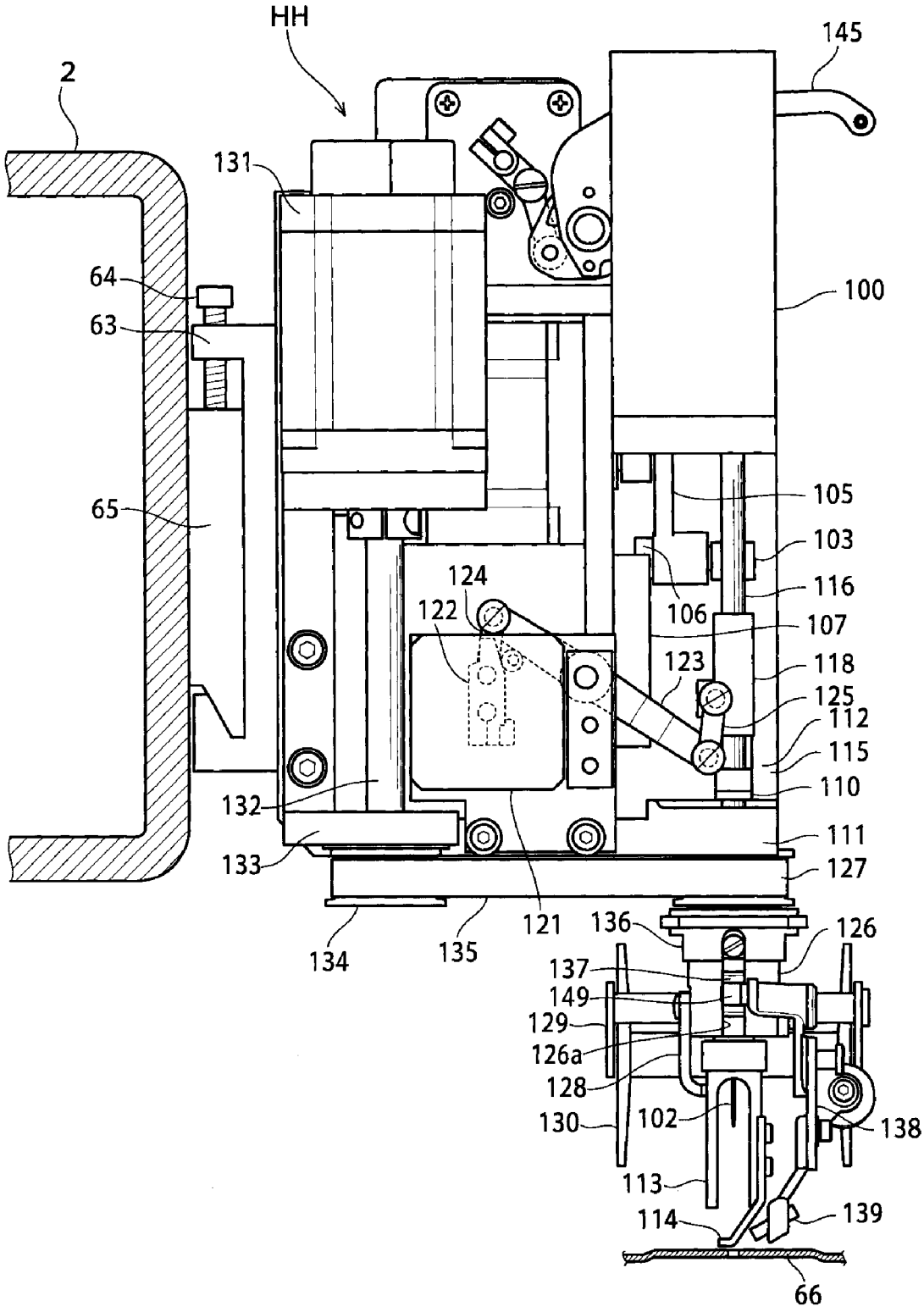
FIG. 14 is a left side view the handwheel-operated lock-stitching head.
Figure 15:
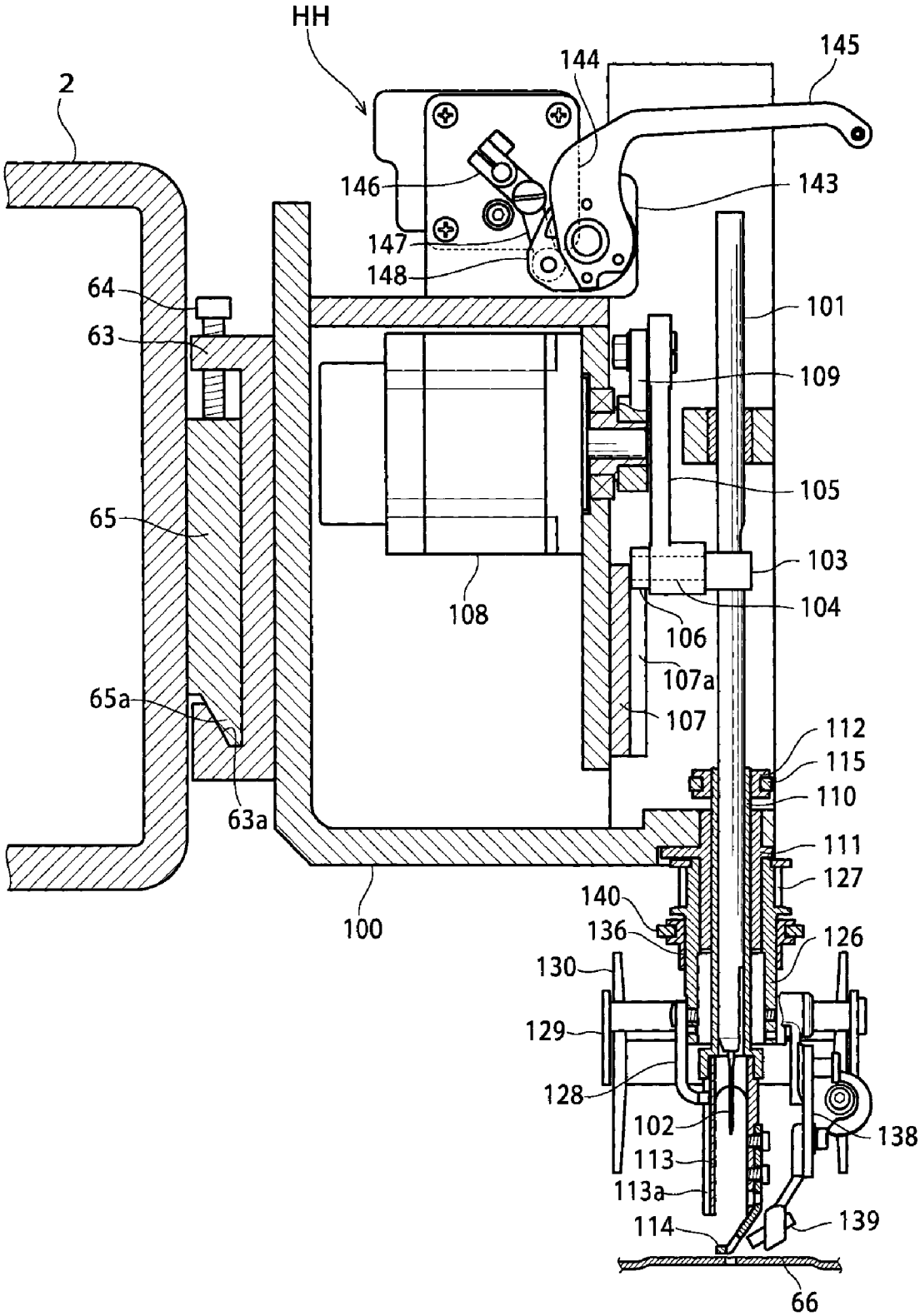
FIG. 15 is a sectional left side view the handwheel-operated lock-stitching head.

Now, a description will be given about an embodiment where the basic principles of the present invention are applied to the "handwheel-operated lock-stitching head" HH capable of sewing a string-shaped material, with reference to FIGS. 13 to 15. FIG. 13 is a front view of the handwheel-operated lock-stitching head HH employed in the embodiment of the present invention, and FIGS. 14 and 15 are a left side view and sectional left side view, respectively, of the handwheel-operated lock-stitching head HH. The handwheel-operated lock-stitching head HH has an arm 100 on which are provided separate driving motors corresponding to various mechanical components, and the head HH is constructed as a module independent of the upper frame 2. More specifically, on the arm 100 of the handwheel-operated lock-stitching head HH, there are provided a needle bar driving motor 108 for moving up and down a needle bar 101, a presser foot driving motor 121 for moving up and down a presser foot support 113, an orientation controlling motor 131 for controlling the orientation of a rotary cylinder 126, a zig-zag motor 142 for moving a guide lever 138 in alternating directions and a thread take-up lever driving motor 144 for pivoting a thread take-up lever 145.

Needle Bar Driving Mechanism

As illustratively shown in FIG. 15, the needle bar 101 is vertically movably supported on the arm 100, and a sewing needle 102 is fixed to the lower end of the needle bar 101. Needle bar clamp 103 is fixed to a substantial longitudinal middle portion of the needle bar 101. The needle bar clamp 103 has a horizontal shaft portion 104 extending in the front-rear direction of the sewing machine, and one end of a connecting arm 105 is connected to the shaft portion 104. Roller 106 is provided at a rear end portion of the shaft portion 104, and the roller 106 is fitted in a vertical groove 107*a* of a guide rail 107 fixed to the arm 100 so that rotation of the needle bar 101 about its axis is prevented. The connecting arm 105 is pivotably connected at the other end to the distal end of a drive lever 109 that is in turn fixed to the motor shaft of the needle bar driving motor 108. Thus, as the drive lever 109 is rotated by being driven via the needle bar driving motor 108, the needle bar 101 moves up and down.

Presser Foot Driving Mechanism

As shown in FIGS. 14 and 15, a support cylinder 110 is fitted over the outer periphery of the needle bar 101, and this support cylinder 110 is guided along the inner peripheral surface of a sleeve 111 that is fixed to a lower end portion of the arm 100. Thus, the support cylinder 110 is movable upward and downward relative to the needle bar 101 and rotatable about its axis. Ring 112 is fixed to an upper end portion of the support cylinder 110, and the presser foot support 113 is fixed to a lower end portion of the support cylinder 110. The presser foot support 113 has a bifurcated shape having two opposed leg sections. One of the leg sections of the support 112 has a vertically elongated key groove 113*a* formed in its outer surface, and a presser foot 114 is fixed to a lower end portion of the other leg portion.

As shown in FIG. 13, a distal end portion (forked portion) of a drive arm 115 engages with the ring 112 of the support cylinder 110, so as to transmit a vertical drive force to the support cylinder 110. The drive arm 115 is mounted in such a manner that it is positionally adjustable relative to a vertically-movable or elevator member 117 that is in turn vertically movably supported on a guide shaft 116 fixed to and oriented vertically relative to the arm 100. Base elevator member 118 is vertically movably supported on the guide shaft 116, and part of the elevator member 117 is received in the base elevator member 118 via a block 119. The elevator member 117 is normally biased, by a spring 120 provided on the guide shaft 116 between the two elevator members 117 and 118, in a direction where the elevator member 117 is pressed downward against the block 119.

As seen in FIG. 4, a drive lever 122 is fixed to the motor shaft of the presser foot driving motor 121, and the distal end of the drive lever 122 is connected, via a link member 124, to one end portion of a pivot arm 123 pivotably supported on the arm 100. The pivot arm 123 is connected at its other end portion to the base elevator member 118 via a link member 125. Thus, as the pivot arm 123 reciprocatively pivots by being driven by the presser foot driving motor 121, the base elevator member 118 and elevator member 117 move up and down so that the support cylinder 110 moves up and down together with the presser foot support 113 (presser foot 114) via the drive arm 115. The presser foot 114 is driven to move up and down with a short stroke during a sewing operation, and it is evacuated upward to the evacuated position upon termination of the sewing operation or when the handwheel-operated lock-stitching head HH is to be brought to a resting position. FIGS. 13-15 shows conditions of the sewing machine when the presser foot 114 is at its lower dead point position.

Note that the bottom dead point of the presser foot 114 may rise depending on the type of a string-shaped material to be sewn; in such a case, the downward movement of the elevator member 117 is stopped and only the base elevator member 118 moves downward against the resiliency of the spring 120, to permit the rise of the bottom dead point.

Rotary Cylinder Orientation Control Mechanism

As shown in FIG. 15, the rotary cylinder 126 is mounted on the outer periphery of the fixed sleeve 111 in such a manner that it is only rotatable about its axis. The rotary cylinder 126 has a pulley 127 provided on the outer periphery of its upper end portion, and a key member 128 engaged in the key groove 113*a* of the presser foot support 113 is fixed to a lower end portion of the rotary cylinder 126. Bobbin bracket 129 is fixed to the outer periphery of the rotary cylinder 126, and a bobbin 130 having an elongated string-shaped material wound thereon is rotatably supported on the bobbin bracket 129. As shown in FIGS. 13 and 14, a shaft 132 is connected to the motor shaft of the orientation controlling motor 131 that controls the orientation of the rotary cylinder 126, and the shaft 132 is rotatably supported at its lower end by a base member 133 fixed to the arm 100. Driving pulley 134 is fixed to a lower end portion of the shaft 132, and a timing belt 135 is wound at its opposite ends on, and extends between, the driving pulley 134 and the pulley 127 of the rotary cylinder 126. Thus, as the rotary cylinder 126 rotates by being driven by the orientation controlling motor 131, not only the bobbin 130 rotates about the needle bar 101, but also the presser foot support 113 and presser foot 114 reciprocatively rotate about the needle bar 101.

Zig-Zag Mechanism

Interlocking member 136 is provided on the outer periphery of the rotary cylinder 126 in such a manner that it is vertically movable and rotatable relative to the cylinder 126. The interlocking member 136 has a connecting piece 137 fixed thereto, and the connecting piece 137 has a lower end portion engaged in an engaging groove 126*a* formed in the outer periphery of the rotary cylinder 126. Thus, the connecting member 136 is rotatable together with the rotary cylinder 126. Guide lever 138 is pivotably connected to the rotary cylinder 126, and a roller 149 attached to the distal end of an upper arm portion of the guide lever 138 is fitted in a groove 137*a* of the connecting piece 137. Pipe-shaped guide 139 for guiding the string-shaped material to the needle entry position of the sewing needle 102 is fixed to the lower end of the guide lever 138. Forked portion 140*a* of an elevator member 140 is engaged in a groove formed in and along the outer periphery of the interlocking member 136 in such a manner that it can transmit a vertical driving force. The elevator member 140 is vertically movably supported on a guide shaft 141 that is vertically oriented relative to the arm 100, and it moves up and down by being driven by a zig-zag motor 142 via a not-shown driving mechanism. Thus, as the interlocking member 136 and connecting piece 137 vertically move by being driven by the zig-zag motor 142, the guide lever 138 oscillates to oscillate or move a portion of the string-shaped material, having been delivered to the needle entry position, in alternating directions in synchronism with the reciprocative vertical movement of the needle bar 101, so that the string-shaped material is sequentially sewn to the workpiece or fabric through so-called zig-zag sewing. Further, the reciprocative rotation of the rotary cylinder 126 by the orientation controlling motor 131 is controlled so that the guide 139 of the guide lever 138 is located ahead in a direction of relative advancing movement of the handwheel-operated lick-stitching head HH based on the movement of the sewing workpiece (fabric). In this manner, the string-shaped member can be appropriately guided to the needle entry position of the sewing needle 102.

Thread Take-Up Lever Driving Mechanism

As clearly seen from FIG. 15, the thread take-up lever driving motor 144 is fixed to an upper end portion of the arm 100 via a bracket 143, and the thread take-up lever 145 is pivotably supported on the bracket 143. Drive lever 146 is fixed to the motor shaft of the take-up lever driving motor 144. The drive lever 146 is connected at its distal end to a boss section 148 of the thread take-up lever 145 via a connecting arm 147. Thus, as the drive lever 146 is reciprocatively driven by the take-up lever driving motor 144, the take-up lever 145 is caused to reciprocatively pivot. Switching between Heads or Combination of Heads As shown in FIGS. 14 and 15, a fixation member 63, similar to that for the ordinary embroidering head H, is fixed to the rear surface of the handwheel-operated lock-stitching head HH. Thus, in the multi-head embroidery sewing machine shown in FIG. 1 or 12, the handwheel-operated lock-stitching head HH can be fixed to the upper frame 2 of the machine in place of the ordinary embroidering head H in a desired head position. In the single multi-head embroidery sewing machine of the present invention, the ordinary embroidering heads H (first-type heads or supports) and the handwheel-operated lock-stitching heads HH (second-type heads or supports) may be provided on the frame 2 in any desired combination.

Figure 16:
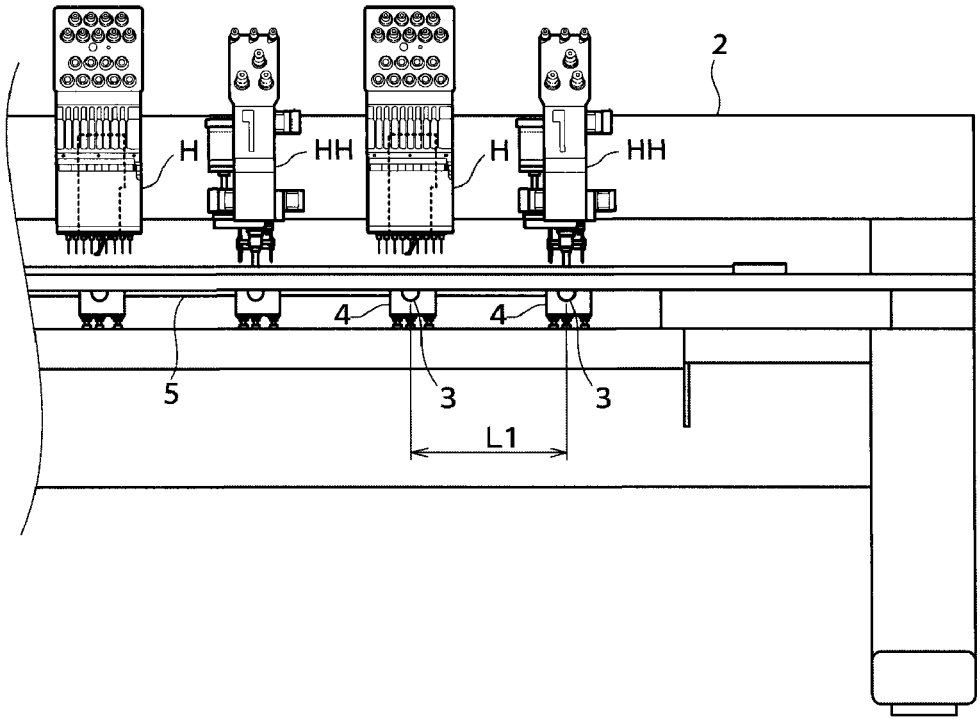
FIG. 16 is a fragmentary front view showing an example of the multi-head embroidery sewing machine capable of performing combination embroidery by being provided with a combination of ordinary embroidering heads and handwheel-operated lock-stitching heads.
Figure 17:
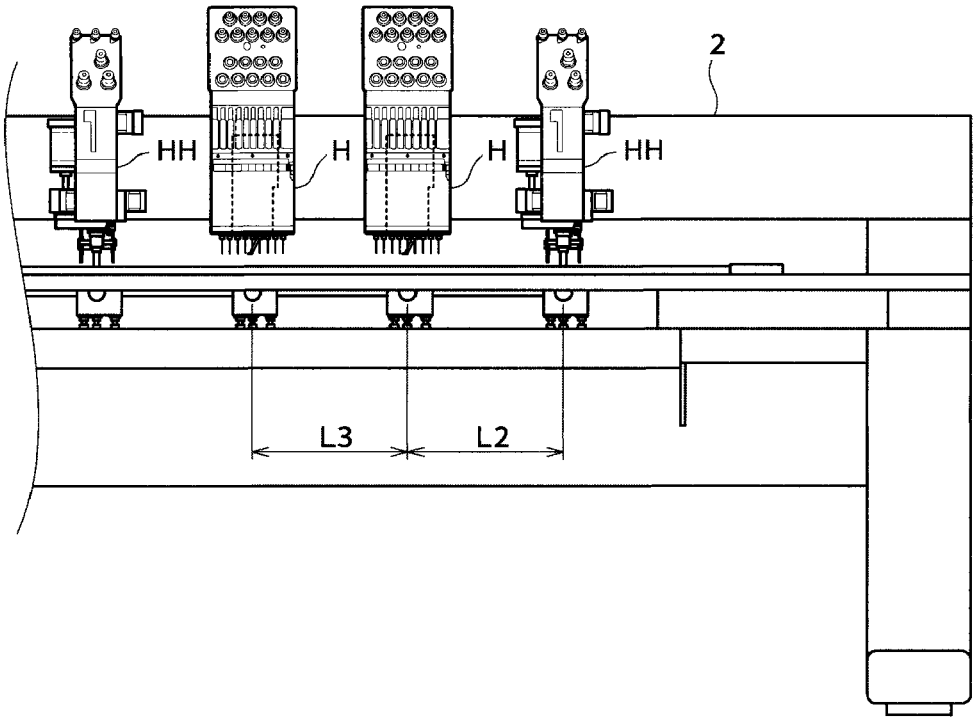
FIG. 17 is a fragmentary front view showing another example of the combination of ordinary embroidering heads and handwheel-operated lock-stitching heads in the multi-head embroidery sewing machine capable of performing combination embroidery.
Figure 18:
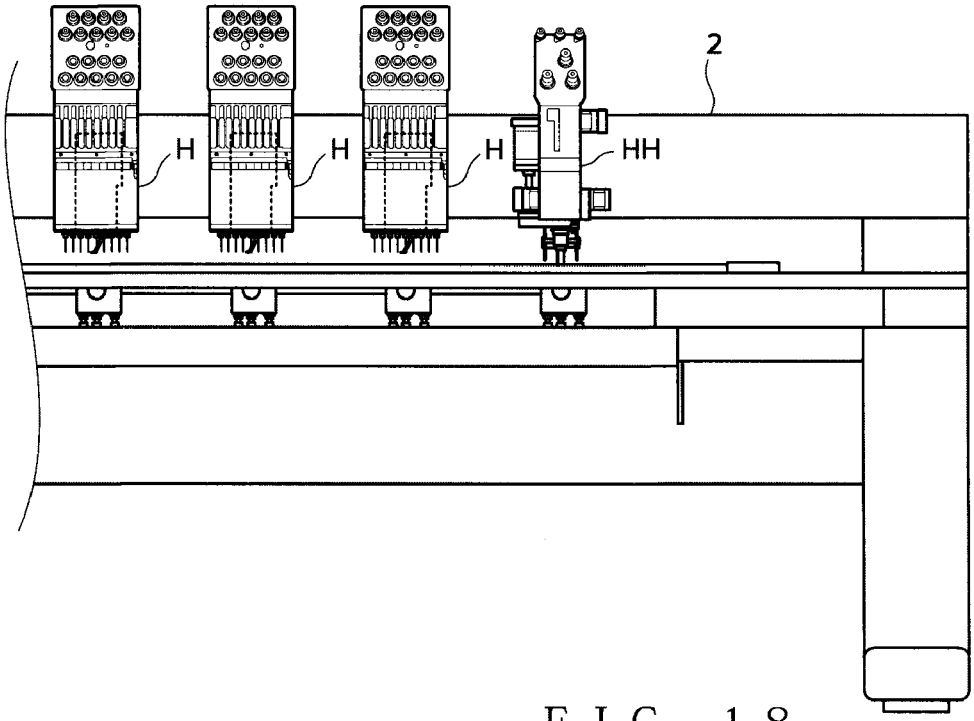
FIG. 18 is a fragmentary front view showing still another example of the combination of ordinary embroidering heads and handwheel-operated lock-stitching heads in the multi-head embroidery sewing machine capable of performing combination embroidery.

FIGS. 16-18 show several examples of combinations of the ordinary embroidering heads H and handwheel-operated lock-stitching heads HH. In FIG. 16, there is shown a multi-head embroidery sewing machine where odd-numbered (as counted from the right in the figure) machine heads are handwheel-operated lock-stitching heads HH and even-numbered machine heads are ordinary embroidering heads H. By positioning the handwheel-operated lock-stitching heads HH and ordinary embroidering heads H in pairs as illustrated in the figure, it is possible to readily provide a sewing machine construction which can perform combination embroidery that comprises ordinary multi-color embroidery and decorative embroidery achieved by sewing of a string-shaped (or strand-like) material. In this case, the controller and operation panel of the embroidery sewing machine is shared between the two types of heads H and HH. Note that, to perform the combination embroidery in this sewing machine, the odd-numbered and even-numbered machine heads are caused to operate alternately. When lock-stitching sewing is to be performed, for example, only the even-numbered machine heads (i.e., ordinary embroidering heads H) are brought into the operating condition with the odd-numbered machine heads (handwheel-operated lock-stitching heads HH) kept in the non-operating condition. In this way, ordinary multi-color embroidery is carried out by the ordinary embroidering heads H. When handle-wheel-operated sewing is to be performed, the embroidery frame 7 is moved by a distance L1 between the selected needles of two adjoining machine heads H and HH, and then only the odd-numbered machine heads (i.e., handwheel-operated lock-stitching heads HH) are brought into the operating condition with the even-numbered machine heads (embroidering heads H) kept in the non-operating condition. In this way, embroidered areas, on which the ordinary multi-color embroidery has been performed with the ordinary embroidering heads H, are moved to the positions of the handwheel-operated lock-stitching heads HH (needle-to-needle movement), so that decorative sewing is performed on the moved embroidered areas. The user or human operator can perform operation for setting the operating and non-operating conditions of the machine heads H and HH via the operation panel, and the needle-to-needle movement at the time of the operating-head switching or replacement is automatically carried out in accordance with embroidery sewing data.

In FIG. 17, there is shown a multi-head embroidery sewing machine which includes groups of machine heads each comprising three machine heads, the rightmost (or first) one being a handwheel-operated lock-stitching head HH, the middle (or second) and leftmost (or third) ones being ordinary embroidering heads H. In this way, this sewing machine is capable of performing combination embroidery consisting of a combination of multi-color embroidery by the two ordinary embroidering heads H of each of the groups (if each of the embroidering heads H has nine colors (i.e., nine needle bars, multi-color embroidery of 18 colors can be performed) and decorative embroidery for sewing string-shaped materials. The sewing machine of FIG. 17 is operated in generally the same manner as described above, by switching among the first to third machine heads HH and H of each of the groups with needle-to-needle movement over respective distances L2 and L3.

In FIG. 18, there is shown a multi-head embroidery sewing machine which includes groups of machine heads each comprising two machine heads, the right one of them being a handwheel-operated lock-stitching head HH, the other of them being an ordinary embroidering head H. In this way, this sewing machine is capable of performing test-sewing through handwheel operated lock-stitching sewing via the heads HH.

Handwheel-Operated Lock-Stitching Head Equipped with Boring Device

Figure 20:
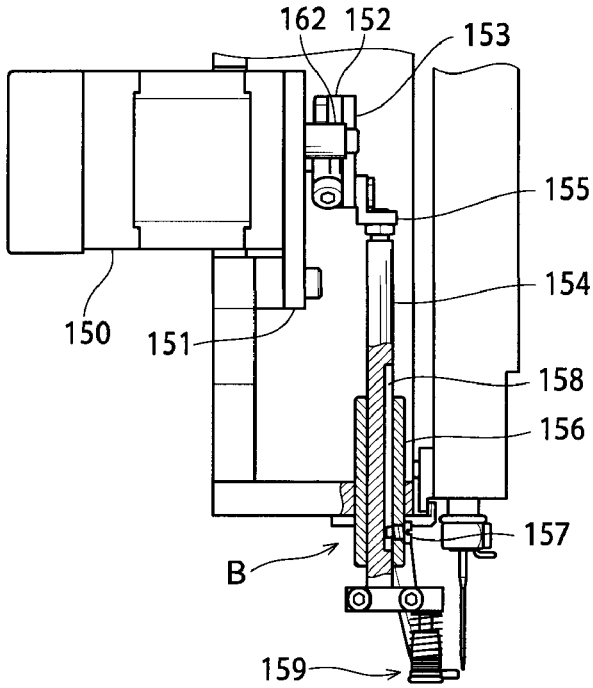
FIG. 20 is a fragmentary sectional side view of the boring device shown in FIG. 19.
Figure 20:
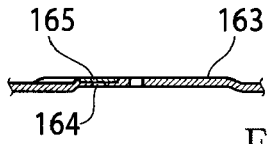
Figure 19:
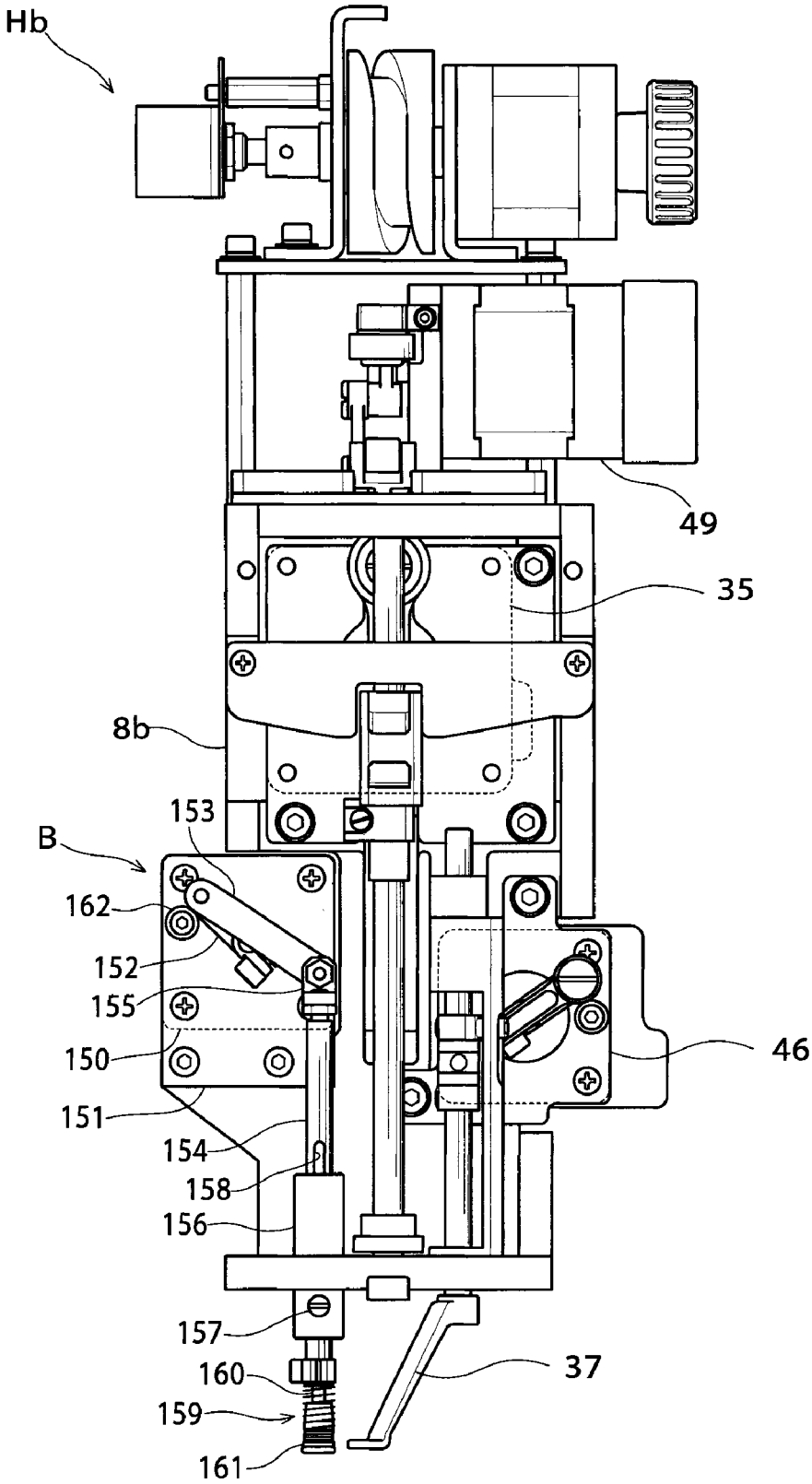
FIG. 19 is a front view showing an embodiment of an embroidering head equipped with a boring device applicable to the present invention.

As a modification of the lock-stitching head H, there may be used an embroidering head provided with a boring device. FIG. 19 is a front view of an arm (or support) 8*b*, which particularly shows an example of such an embroidering head Hb provided with a boring device with the needle bar case, provided on the machine front, omitted for clarity. Embroidery head Hb including the arm 8*b* is different from the aforementioned lock-stitching embroidering head H shown in FIG. 5 or the like only in that it is equipped with the boring device B and may be constructed similarly to the latter otherwise. FIG. 20 is a partially-sectional side view of the boring device B.

As shown in FIGS. 19 and 20, the boring device B includes a driving motor 150 fixed to the arm 8*b* via a base member 151. Drive lever 152 is fixed to the motor shaft of the driving motor 150. The drive lever 152 is connected, via a connecting lever 153, with a bracket 155 fixed to an upper end portion of a knife bar 154. The knife bar 154*b* is vertically movably supported in a sleeve 156 fixed to a lower end portion of the arm 8*b*. Limiting pin 157 is fixed to the sleeve 56, and the knife bar 154 has an engaging groove 158, in which a distal end portion of the limiting pin 157 is engaged, formed therein over a length corresponding to a range of the vertical movement of the knife bar 158. By the engagement between the limiting pin 157 and the engaging groove 158, rotation of the knife bar 154 about its axis is prevented. Knife unit 159 is fixed to a lower end portion of the knife bar 154, and this knife unit 159 is of the conventional construction including a boring knife 160 and presser 161.

Figure 21:
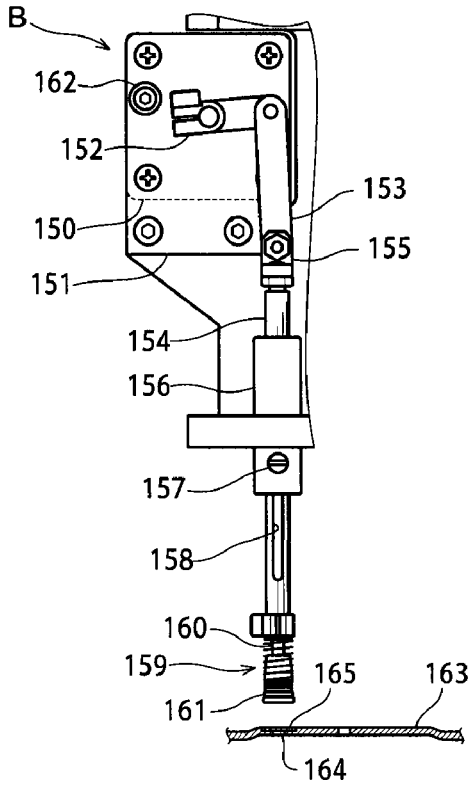
FIG. 21 is a front view showing conditions of the boring device of FIG. 19 when the boring device is in its top dead point position during a boring operation.

Thus, as the drive lever 152 pivots by being driven via the driving motor 150, the knife unit 159 vertically moves together with the knife bar 154. FIGS. 19 and 20 show conditions of the sewing machine when the knife unit 159 is in its evacuated position. In this state, the drive lever 152 is held in abutment against a stopper 162 fixed to the base member 152. In a boring (i.e., puncturing) operation, the knife unit 159 is reciprocatively driven between its top dead point position of FIG. 21 and its bottom dead point position of FIG. 22. Note that, in the boring (puncturing) operation, no sewing is performed with the respective driving motors 35, 46 and 49 for the needle bar, presser foot and thread take-up lever kept deactivated.

Figure 22:
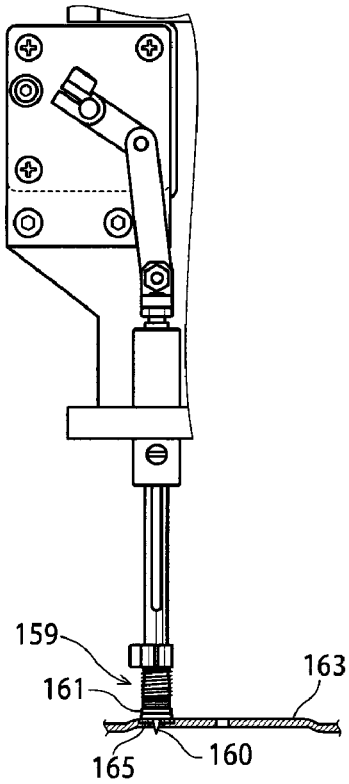
FIG. 22 is a front view showing conditions of the boring device of FIG. 19 when the boring device is in its bottom dead point position during the boring operation.
Figure 23:
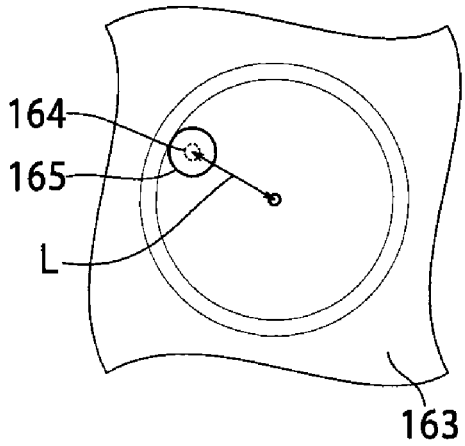
FIG. 23 is a fragmentary plan view of a needle plate used in correspondence with the embroidering head equipped with the boring device.

FIG. 23 is a fragmentary plan view of a needle plate (or throat plate) 163 that has a needle hole for passage therethrough of a sewing needle as conventionally known in the art. The needle plate 163 also has a knife hole 164 formed, in a position thereof corresponding to the knife unit 159, for passage therethrough the boring knife 160. Cushion member 165, against which the presser 161 presses, is provided on an upper end edge portion of the knife hole 164. While the knife unit 159 is in its bottom dead point position as shown in FIG. 22, a sewing workpiece (embroidering fabric) is held pressed between the presser 161 and the cushion member 165, and the boring knife 160 passes through the knife hole 164 to cut open the sewing workpiece (embroidering fabric).

Figure 24:
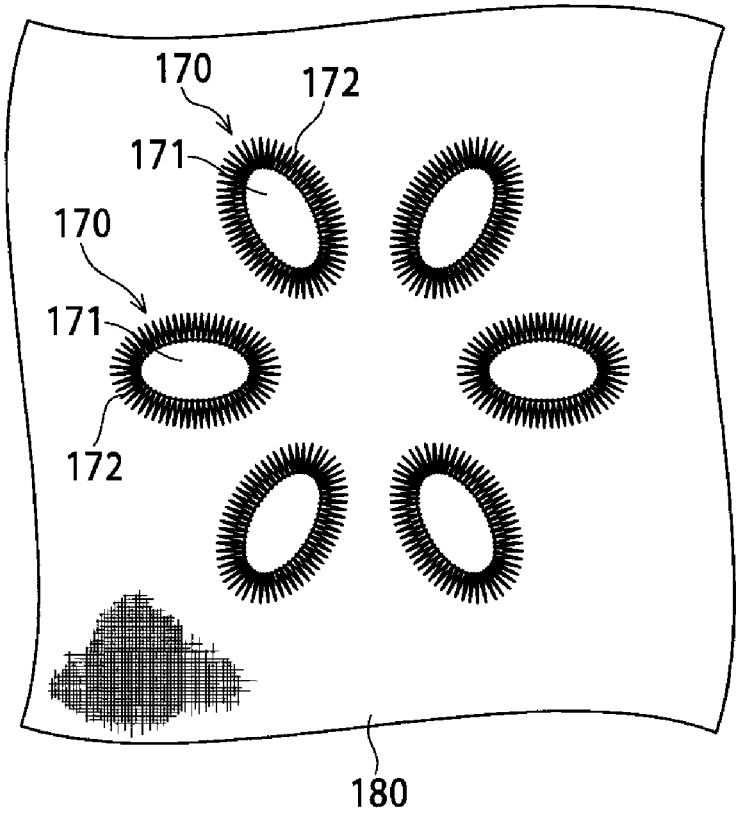
FIG. 24 is a plan view showing an example of boring patterns made by the embroidering head equipped with the boring device.
Figure 25:
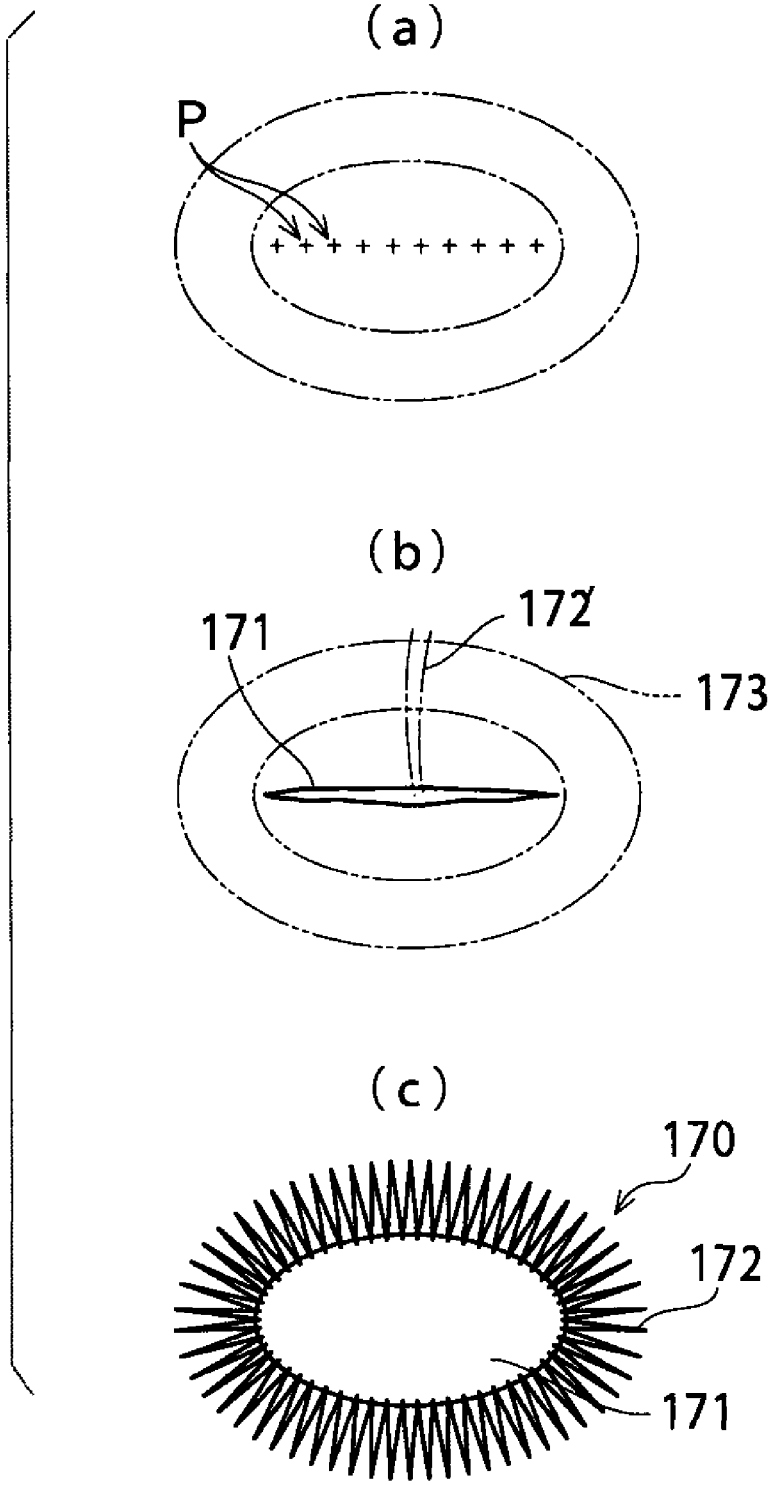
FIG. 25 is a plan view explanatory of an example manner in which a boring pattern is made in the embodiment.

FIG. 24 shows six radial embroidery patterns 170 formed by boring (hereinafter referred to as "boring patterns") and arranged generally circularly at angular intervals. The following lines describe an example manner in which the boring patterns shown in FIG. 24 are formed. In starting the boring operation, the embroidery frame (support frame) 7 is moved by an offset amount L (see FIG. 23) between the sewing needle and the knife unit 159, and a portion of an embroidering workpiece to be punctured is brought into positional correspondence to the knife unit 159. Then, the knife unit 159 is reciprocatively driven by a driving motor 150 and the embroidery frame (support frame) 7 is driven on the basis of embroidery data, so that the boring knife 160 is caused to sequentially penetrate a series of points P of the embroidering fabric to cut open the fabric as shown in (a) of FIG. 25 and thereby make an opening (hereinafter "boring opening") 171 in the fabric as shown in (b) of FIG. 25. Upon completion of the boring operation, the reciprocative driving of the knife unit 159 is brought to an end, and the embroidery frame (support frame) 7 is returned by the offset amount L. Then, not only the respective driving motors 35, 46 and 49 for the needle bar (14), presser foot 37 and thread take-up lever (23) are activated but also the embroidery frame (support frame) 7 is driven, and then overlooked stitches 172 are formed on and along the edge of the boring opening 171 to thereby form a boring pattern 170 as shown in (b) and (c) of FIG. 25. In forming the overlooked stitches 172 as noted above, the sewing needle is dropped alternately in the boring opening 171 and on an imaginary outer peripheral line 173 of the boring pattern 170 to be formed, to cause entwining of a sewing thread 172'. Thus, each individual stitch of the thread 172' dropped in the boring opening 171 is dawn toward the outer peripheral line 173, so that the boring pattern 170 can be formed as shown in (c) of FIG. 25. After completion of formation of one boring pattern 170, the respective driving motors 35, 46 and 49 for the needle bar (14), presser foot 37 and thread take-up lever (23) are deactivated, and the boring operation for the next boring pattern 170 is initiated. The aforementioned operational sequence is repeated to form six boring patterns 170 as shown in FIG. 24.

Because the boring and overlocked-stitch forming operations are performed for each of the boring patterns 170 corresponding to the openings 171 as set forth above, it is possible to accurately form each individual boring pattern 170 and prevent unwanted positional deviations (pattern deviations) between the openings 171 and the overlocked stitches 172. However, with the conventional technique where a plurality of openings are formed collectively followed by locked stitch formation along the edges of the openings, positional deviations (pattern deviations) tend to occur between the openings 171 and the overlooked stitches 172 due to drawing-up of the fabric, which tends to cause positional deviations between the openings 171 and the overlooked stitches 172. The instant embodiment arranged in the aforementioned manner can avoid such an inconvenience.

Further, in the sewing machines, such as the instant embodiment, where the mechanical components, such as the needle bar, presser foot and thread take-up lever, are driven separately by their respective driving motors 35, 46 and 49, start and stop of the driving can be controlled independently and at high speed for each of the mechanical components, and thus, the boring operation by the boring device B and overlock stitching operation by the sewing needle 16 can be carried out without lowering the operation speed of the sewing machine, so that the boring pattern embroidering can be carried out at high speed. Further, by varying the driving amount of the driving motor 50, the penetrating depth of the boring knife 160 into the embroidering fabric 180, and thus, the size of the boring opening 171 that can be formed by one reciprocative movement of the boring knife 160 can be adjusted as desired. Such size adjustment of the boring opening 171 can flexibly deal with characteristics of the embroidering fabric 180 and form of the boring pattern (e.g., size of the boring opening). In the instant embodiment, the knife unit 159 may be retracted to the evacuated position as shown in FIG. 20 either only when the sewing machine and embroidering head are to be brought to the non-operating condition or also when an embroidery operation is to be performed.

The embroidering head Hb provided with the boring device as shown in FIG. 19 is of a modulized construction similarly to the other machine heads described above. Thus, at the time of replacement or repair of any one of the component parts, the whole embroidering head Hb can be readily replaced as an integral unit. Further, in the single sewing machine, switching can be freely made between different sewing functions of individual machine heads, by appropriately replacing the embroidering head Hb with another type of machine head (e.g., H or HH). In the case where the embroidering head Hb provided with the boring device is employed, it is absolutely necessary that the needle plate 163 having the knife hole 164 be used. Such a needle plate 163 having the knife hole 164 may also be applied to other types of machine heads, such as the lock-stitching head H and handle-wheel-operated lock-stitching head HH.

The aforementioned arrangements for modulizing a machine head in accordance with the present invention are applicable not only to a multi-head embroidery sewing machine but also to a single-head embroidery sewing machine. Even in the case where the aforementioned arrangements for modulizing a machine head are applied to a single-head embroidery sewing machine, entirely different types of embroidery (such as multi-color embroidery, handwheel-operated embroidery and boring embroidery) can be performed by just attaching various types of machine heads, one type of machine head at a time, to the embroidery sewing machine. As a result, the user only has to purchase one embroidery sewing machine and one or more desired types of replacing machine heads, without purchasing different types of embroidery sewing machines as done in the past, which is very economical.

What is claimed is:

1. A multi-head embroidery sewing machine including a plurality of machine heads each provided with a plurality of sewing mechanical components that include a needle bar driving mechanism, thread take-up lever and presser foot mechanism, said embroidery sewing machine comprising:

individual motors provided per machine head for individually driving respective ones of the mechanical components including the needle bar driving mechanism, thread take-up lever and presser foot mechanism;

a common motor provided for driving a plurality of rotary hooks that are disposed beneath the respective machine heads; and a transmission mechanism for transmitting rotation of said common motor to the rotary hook of each of the machine heads, wherein each of the machine heads has a needle bar case that is slidably mounted thereon and that has a plurality of needle bars, and which further comprises a needle bar case moving mechanism provided per machine head, each of said needle bar case driving mechanisms selectively positioning any one of the needle bars of the machine head, corresponding thereto, in a position where the one needle bar is drivable by said needle bar driving mechanism.

2. A multi-head embroidery sewing machine as claimed in claim 1 which further comprises a motor provided, per machine head, as a drive source for said needle bar case moving mechanism.

3. A multi-head embroidery sewing machine including a plurality of machine heads each provided with a plurality of sewing mechanical components that include a needle bar driving mechanism, thread take-up lever and presser foot mechanism, said embroidery sewing machine comprising:

individual motors provided per machine head for individually driving respective ones of the mechanical components including the needle bar driving mechanism, thread take-up lever and presser foot mechanism;

a common motor provided for driving a plurality of rotary hooks that are disposed beneath the respective machine heads; and a transmission mechanism for transmitting rotation of said common motor to the rotary hook of each of the machine head, wherein at least one of the plurality of machine heads has a mechanical component attached thereto for performing decorative sewing, wherein said mechanical component for performing decorative sewing is intended to perform decorative sewing of a string-shaped material, and wherein said mechanical component for performing decorative sewing of a string-shaped material includes an orientation control mechanism for controlling an orientation of a bobbin containing the string-shaped material, and a guide mechanism for guiding the string-shaped material to a needle entry area.

4. A multi-head embroidery sewing machine including a plurality of machine heads each provided with a plurality of sewing mechanical components that include a needle bar driving mechanism, thread take-up lever and presser foot mechanism, said embroidery sewing machine comprising:

individual motors provided per machine head for individually driving respective ones of the mechanical components including the needle bar driving mechanism, thread take-up lever and presser foot mechanism;

a common motor provided for driving a plurality of rotary hooks that are disposed beneath the respective machine heads; and a transmission mechanism for transmitting rotation of said common motor to the rotary hook of each of the machine heads, wherein said plurality of machine heads include at least one of a first-type machine head for performing ordinary sewing and a second-type machine head equipped with a mechanical component for performing decorative sewing, and wherein the first-type and second-type machine heads are replaceably mounted to predetermined mounting positions of a machine frame.

5. An embroidery sewing machine as claimed in claim 1 wherein said presser foot mechanism includes:

a presser foot;

a motor for driving said presser foot, said motor being one of said individual motors;

a motion conversion mechanism for vertically moving, in response to activation of the motor, said presser foot between predetermined top and bottom dead points during a sewing operation, and for retracting, in response to activation of the motor, said presser foot to an evacuated position when no sewing operation is to be performed, and wherein, in retracting said presser foot to the evacuated position, said motion conversion mechanism rotates said presser foot so as to cause a needle hole, formed at a distal end portion of said presser foot, to escape from a needle position.

6. A multi-head embroidery sewing machine including a plurality of machine heads each provided with a plurality of sewing mechanical components that include a needle bar driving mechanism, thread take-up lever and presser foot mechanism, said embroidery sewing machine comprising:

individual motors provided per machine head for individually driving respective ones of the mechanical components including the needle bar driving mechanism, thread take-up lever and presser foot mechanism;

a control device for individually controlling each of the individual motors per machine head; and a setting section for individually setting content of control, by said control device, of each of the motors per machine head, wherein said setting section sets, independently for each of the machine heads, a sewing operation trajectory of at least one of the plurality of sewing mechanical components, and wherein said setting section includes a storage section that stores a plurality of pieces of information for setting a plurality of different sewing operation trajectories of at least one of the plurality of sewing mechanical components, and a section that selects, per machine head, a desired sewing operation trajectory from among the plurality of different sewing operation trajectories stored in said storage section.

7. A multi-head embroidery sewing machine as claimed in claim 6 which further comprises a common motor provided for driving a plurality of rotary hooks that are disposed beneath respective ones of the machine heads, and wherein said control device controls said individual motors per machine head on the basis of a rotational position of said common motor.

8. A sewing machine comprising:

a support provided on a machine frame and having mounted thereon a plurality of sewing mechanical components that include a needle bar driving mechanism, thread take-up lever and presser foot mechanism, a rotary hook being disposed beneath said support;

individual motors mounted on said support for individually driving respective ones of the mechanical components including the needle bar driving mechanism, thread take-up lever and presser foot mechanism, said support being constructed as a modulized support, said modulized support being detachably attached, as an integral unit, to the machine frame; and a positioning structure for mounting said modulized support to a predetermined position of the machine frame, said positioning structure being provided on the predetermined position of the machine frame and on said modulized support, wherein said positioning structure sets mounting positions, in an up-and-down direction and left-and-right direction, of said modulized support relative to the predetermined position of the machine frame.

9. A sewing machine as claimed in claim 8 wherein a needle bar case having a plurality of needle bars is slidably mounted on said support.

10. A sewing machine as claimed in claim 9 wherein a motor for sliding said needle bar case is also mounted on said support.

11. A sewing machine comprising:

a support provided on a machine frame and having mounted thereon a plurality of sewing mechanical components that include a needle bar driving mechanism, thread take-up lever and presser foot mechanism, a rotary hook being disposed beneath said support; and individual motors mounted on said support for individually driving respective ones of the mechanical components including the needle bar driving mechanism, thread take-up lever and presser foot mechanism, said support being constructed as a modulized support, said modulized support being detachably attached, as an integral unit, to the machine frame, wherein a mechanical component for performing decorative sewing is also mounted on said support, and wherein said mechanical component for performing decorative sewing is intended to perform decorative sewing of a string-shaped material.

12. A sewing machine as claimed in claim 11 wherein said mechanical component for performing decorative sewing of a string-shaped material includes an orientation control mechanism for controlling an orientation of a bobbin containing the string-shaped material, and a guide mechanism for guiding the string-shaped material to a needle entry area.

13. A sewing machine comprising:

a support provided on a machine frame and having mounted thereon a plurality of sewing mechanical components that include a needle bar driving mechanism, thread take-up lever and presser foot mechanism, a rotary hook being disposed beneath said support; and individual motors mounted on said support for individually driving respective ones of the mechanical components including the needle bar driving mechanism, thread take-up lever and presser foot mechanism, said support being constructed as a modulized support, said modulized support being detachably attached, as an integral unit, to the machine frame, wherein said support is one of, a first-type support and a second type support, said first type support having slidably mounted thereon a needle bar case having a plurality of needle bars, said second-type support having mounted thereon a mechanical component for performing decorative sewing, and wherein the first-type and second-type supports are replaceably mounted to predetermined mounting positions of the machine frame.

14. A sewing machine as claimed in claim 8 wherein the presser foot mechanism includes:

a presser foot;

a motor for driving said presser foot, said motor being one of said individual motors;

a motion conversion mechanism for vertically moving, in response to activation of the motor, said presser foot between predetermined top and bottom dead points during a sewing operation, and for retracting, in response to activation of the motor, said presser foot to an evacuated position when no sewing operation is to be performed, and wherein, in retracting said presser foot to the evacuated position, said motion conversion mechanism rotates said presser foot so as to cause a needle hole, formed at a distal end portion of said presser foot, to escape from a needle position.

15. A sewing machine as claimed in claim 8 which includes a plurality of the supports and a plurality of the rotary hooks corresponding to the supports, and wherein each of the supports can be individually attached and detached to and from the machine frame.

* * * * *